US011506213B2

(12) United States Patent
Kim et al.

(10) Patent No.: US 11,506,213 B2
(45) Date of Patent: Nov. 22, 2022

(54) CEILING FAN AND ASSEMBLING METHOD THEREOF

(71) Applicant: LG ELECTRONICS INC., Seoul (KR)

(72) Inventors: Taejun Kim, Seoul (KR); Atul Dhiman, Seoul (KR); Shivendra Singh, Seoul (KR); Jeeman Park, Seoul (KR); Yeongcheol Mun, Seoul (KR); Wonsuk Park, Seoul (KR); Siyoung Oh, Seoul (KR); Seokho Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 79 days.

(21) Appl. No.: 16/981,928

(22) PCT Filed: Apr. 2, 2019

(86) PCT No.: PCT/KR2019/003882
§ 371 (c)(1),
(2) Date: Sep. 17, 2020

(87) PCT Pub. No.: WO2019/240360
PCT Pub. Date: Dec. 19, 2019

(65) Prior Publication Data

US 2021/0040953 A1 Feb. 11, 2021

(30) Foreign Application Priority Data

Jun. 12, 2018 (KR) ..... 10-2018-0067488
Jun. 12, 2018 (KR) ..... 10-2018-0067509
(Continued)

(51) Int. Cl.
*F04D 25/08* (2006.01)
*F04D 29/38* (2006.01)
(Continued)

(52) U.S. Cl.
CPC ..... *F04D 25/088* (2013.01); *F04D 29/384* (2013.01); *F04D 29/34* (2013.01); *F04D 29/646* (2013.01)

(58) Field of Classification Search
None
See application file for complete search history.

(56) References Cited

U.S. PATENT DOCUMENTS 2,790,596 A 4/1957 Stirling
5,562,412 A 10/1996 Antonelli
(Continued)

FOREIGN PATENT DOCUMENTS

CN 106015053 A 10/2016
EP 2805061 A1 11/2014
(Continued)

OTHER PUBLICATIONS

International Search Report from PCT/KR2019/003882, dated Jul. 19, 2019.
(Continued)

*Primary Examiner* — Juan G Flores
(74) *Attorney, Agent, or Firm* — Dentons US LLP

(57) ABSTRACT

A ceiling fan may include a shaft coupled to a ceiling, a cover to surround the shaft, a main blade having a blade hole which is a space open inward, and a sub-blade positioned in the blade hole. The sub-blade is disposed to have an angle of attack different from an angle of attack of the main blade. The ceiling fan may resolve a red zone of the air flow and may improve air volume and the flow rate due to the dual blades.

16 Claims, 26 Drawing Sheets

(30) Foreign Application Priority Data

Jun. 12, 2018 (KR) ..... 10-2018-0067649
Jun. 12, 2018 (KR) ..... 10-2018-0067671
Mar. 15, 2019 (KR) ..... 10-2019-0030051

(51) Int. Cl.
*F04D 29/34* (2006.01)
*F04D 29/64* (2006.01)

(56) References Cited

U.S. PATENT DOCUMENTS

| | | | | |
|---|---|---|---|---|
| D400,667 | S * | 11/1998 | Moody | D23/385 |
| D453,563 | S * | 2/2002 | Bogazzi | D23/377 |
| D791,928 | S * | 7/2017 | Yang | D23/413 |
| 2007/0139884 | A1 | 6/2007 | Foster, Sr. et al. | |
| 2013/0189109 | A1* | 7/2013 | Noble | F01D 5/02 416/219 R |
| 2016/0290357 | A1 | 10/2016 | Whitley | |
| 2017/0218962 | A1 | 8/2017 | Yamamoto et al. | |
| 2019/0285084 | A1* | 9/2019 | Yu | F04D 29/388 |

FOREIGN PATENT DOCUMENTS

| | | | |
|---|---|---|---|
| JP | 2001-182689 | A | 7/2001 |
| JP | 2009-250190 | A | 10/2009 |
| WO | 2013/109711 | A1 | 7/2013 |

OTHER PUBLICATIONS

Office Action of Korean Patent Office in Appl'n No. 10-2019-0030051, dated Apr. 28, 2020.

* cited by examiner (a)

(b)

(a)

(b)

(a)

(b)

CEILING FAN AND ASSEMBLING METHOD THEREOF

This application is a National Stage Application of International Application No. PCT/KR2019/003882, filed on Apr. 2, 2019, which claims priority to Korean Patent Application No. 10-2018-0067488, filed on Jun. 12, 2018, Korean Patent Application No. 10-2018-0067509, filed on Jun. 12, 2018, Korean Patent Application No. 10-2018-0067649, filed on Jun. 12, 2018, Korean Patent Application No. 10-2018-0067671, filed on Jun. 12, 2018 and Korean Patent Application No. 10-2019-0030051, filed on Mar. 15, 2019, which are hereby incorporated by reference in their entirety for all purposes as if fully set forth herein.

TECHNICAL FIELD

The present disclosure relates to a ceiling fan and a method for assembling the same.

BACKGROUND ART

A flow generating device refers to a device which drives a fan to generate air flow and to provide the generated air flow to a user. Such a flow generating device is usually called a fan.

The flow generating device may be variously classified according to a flow generation manner, a function, an installation manner, and the like. A device, which is installed on a wall surface or a ceiling, of the flow generating device to generate an air flow is called a ceiling fan.

The ceiling fan has been widely used in homes or malls because the ceiling fan may provide economic advantages to the user as the ceiling fan requires power less than an air conditioner or a general fan.

Generally, the ceiling fan includes a drive motor to provide power and a plurality of blades connected to a shaft of the drive motor.

The ceiling fan may circulate air in a room by using wind generated by the rotation of the blades. Accordingly, the ceiling fan may lower or raise the indoor temperature.

The ceiling fan differs from a conventional flow generating device which is disposed on the ground surface to be erected to concentrate the air flow in a localized space. In detail, the ceiling fan may be positioned on the ceiling higher than the user to force the air flow in a larger volume.

Therefore, the ceiling fan may circulate the air in the entire room to uniformly make the temperature distribution in the room, thereby providing the sense of comfort to the user.

A conventional ceiling fan have the following problems.

First, there is a problem that the airflow is stagnated in the vertically downward region of the ceiling fan, that is, the region where the rotation center of the plurality of blades is located.

Second, as the smaller air flow volume and a slower flow rate are provided, there is a problem that the air-flow reach range is narrow and the temperature sensed by the user varies depending on the indoor position of the user. Accordingly, there is a problem that it is difficult to provide the sense of comfort to the user because the air flow is stagnated in the local space where the airflow fails to reach.

Third, since greater vibration and noise are generated, there is a problem of causing the inconveniences in a user's life such as sleeping.

Fourth, there is a problem of increasing coupling points for the coupling between blades to form a space at the inner center of a plurality of blades. Accordingly, the vibration, the noise, or the decoupling may be generated due to the rotation of the blade. Accordingly, the rotation stability of the ceiling fan may be deteriorated.

Fifth, there is a problem that the coupling between the components is complicated and the separation is relatively difficult. Therefore, there is a disadvantage that the installation convenience and manageability of the ceiling fan are inferior.

Sixth, the effective blade shape for a wind velocity, an air volume, and power consumption may not be suggested in terms of airflow Seventh, the structure of minimizing the flow separation phenomenon of the air, which is caused by the blade, may not be suggested.

The information on a prior art related to this document is as follows.

(Patent Document 1) Publication No. (Published Date): US Patent Application Publication No. US 2017/0218962 A1 (Aug. 3, 2017)

DISCLOSURE

Technical Problem

The present disclosure is to provide a ceiling fan capable of improving air circulation.

The present disclosure is to provide a ceiling fan capable of minimizing the red zone of the air flow, which is formed vertically under the ceiling fan.

The present disclosure is to provide a ceiling fan capable of resolving air stagnation caused in a local space of a room.

The present disclosure is to provide a ceiling fan having an air-flow reach range.

The present disclosure is to provide a ceiling fan in which a relatively uniform temperature distribution is formed in an interior space, thereby making the temperature sensed by a user relatively constant according to the positions of the user in the interior space.

The present disclosure is to provide a ceiling fan capable of minimizing vibration and noise.

The present disclosure is to provide a ceiling fan and a method for assembling the same, in which a plurality of blades are coupled to each other to form a space at the center thereof, and the points where the blades are coupled to each other can be minimized.

The present disclosure is to provide a ceiling fan, capable of stably rotating, and a method for assembling the same.

The present disclosure is to provide a ceiling fan allowing a user to easily assemble or disassemble and a method for assembling the same.

The present disclosure is to provide a ceiling fan capable of preventing a flow separation phenomenon of air generated on a negative pressure surface of a blade.

The present disclosure is to provide a ceiling fan in which the wind speed, air volume and power consumption are improved as compared to a conventional fan.

Technical Solution

In order to accomplish the objects, according to an embodiment of the present disclosure, a ceiling fan may include a shaft coupled to a ceiling, a cover to surround the shaft, a main blade having a blade hole which is a space open inward, and a sub-blade positioned in the blade hole.

Accordingly, the ceiling fan may resolve the red zone of the air flow and may improve air volume and the flow rate due to the dual blades.

Further, the sub-blade may rotate together with the main blade.

In addition, the main blade may include an incision part forming a blade hole having a form of being recessed from an inner surface, In addition, the incision part may include an upper incision part formed in the top surface of the main blade and a lower incision part formed in a bottom surface of the main blade. In addition, the upper incision part may include a main coupling hole to be coupled to the sub-blade.

In addition, the sub-blade may include a sub-coupling hole corresponding to the main coupling hole.

The main blade may extend such that a chord length is reduced outward.

In addition, in the main blade, the length of the rear end may be longer than the length of the front end.

Further, in the main blade, an outer end may be formed to extend in a radial direction toward the rear portion.

In addition, the outer end may be formed in an oblique shape (or a diagonal shape).

Further, the main blade may include a winglet extending upward from the outer end thereof. In this case, the term "outward" may be defined as a radial direction from the central axis of the ceiling fan.

In addition, the main blade may extend such that the height of the main blade is increased outward (in the radial direction from the central axis of the ceiling fan).

In addition, the main blade extends along the dihedral angle, which is an angle lifted toward the front end (e.g., outer end) from a root portion (or the extension starting point).

In addition, the main blade may extend such that a curved surface is formed rearward from the front end thereof.

In addition, the cover may include an upper cover installed to make contact with the ceiling, a lower cover coupled to a lower portion of the upper cover, and a housing cover positioned such that a space is formed at a lower portion of the lower cover.

In addition, the housing cover may be inserted into the main blade.

In addition, the housing cover may include a cover insertion part spaced apart inward from the lower end of the lower cover by a predetermined distance.

In addition, the cover insertion part may be positioned to be inserted into the lower cover.

In addition, in the housing cover, the diameter of the upper end may be formed to correspond to the diameter of the lower end of the lower cover.

According to another aspect, according to an embodiment of the present disclosure, the ceiling fan includes a blade to improve the air circulation ability.

To this connection, according to an embodiment of the present disclosure, a ceiling fan may include a cover forming an outer appearance, and a blade rotating to allow air to forcibly flow. The blade may include a plurality of main blades coupled to each other, and a plurality of sub-blades positioned in the internal space formed in the center of the plurality of main blades.

In addition, the sub-blades may be provided to correspond to the number of the main blades.

In addition, the ceiling fan may further include a decoration cover installed to be inserted into the main blade.

In addition, in the decoration cover, the internal space may be formed to be divided into the blade hole in which the sub-blade is positioned and a center hole in which the cover is positioned.

According to another aspect, according to an embodiment of the present disclosure, there is suggested a ceiling fan having a structure in which the coupling or decoupling between components is easy.

To this connection, according to an embodiment of the present disclosure, the ceiling fan may include a housing cover to receive a motor shaft coupled to an interior ceiling and an motor assembly to provide power, a plurality of blades including an incision part for forming a hole having a shape of being recessed from the inner surface, and a sub-blade positioned in the hole. A joint part with which the plurality of main blades are couple to each other is fixed in a vertical direction by the housing cover and the sub-blade.

In addition, the joint part may be coupled by the housing cover inserted below and the sub-blade seated above.

In addition, the central portion of the housing cover and the sub-blade may be disposed to cross the joint part in the vertical direction.

In addition, the housing cover, the main blade, and the sub-blade may be changed with each other by a single coupling member.

In addition, in the sub-blade, the main blade, and the housing cover, a hole to be coupled by the single coupling member may be formed.

In addition, the sub-blade may be seated on and coupled to the top surface of the main blade.

Further, the housing cover may include a blade connector protruding from the outer circumferential surface.

In addition, in the blade connector, the central portion may be inserted into a lower portion of the joint part.

Further, a plurality of blade connectors may be formed in number corresponding to the number of the main blades. The plurality of blade connector may be disposed to be spaced apart from each other in the circumferential direction.

In addition, in the main blade, any one of a plurality of connectors is inserted into the inner front end, and another blade connector may be inserted into the inner rear end.

In addition, the main blade may include a front coupling part positioned at an inner front end thereof and extending upward, and a rear coupling part positioned at an inner rear end thereof and extending upward.

In addition, each of the front coupling part and the rear coupling part includes a connector insertion part into which the housing cover is inserted, and a connector seating part formed on a top surface of the connector insertion part to seat the sub-blade thereon.

In addition, the sub-blade may include a sub-connector extending outward from the one end thereof.

In addition, the sub-connector may be seated on the connector seating part.

In addition, the ceiling fan may further include a decoration cover inserted into a decoration hole formed between an upper end and a lower end of the incision.

In addition, the decoration cover may define the hole in which the incision is formed.

According to another aspect, according to an embodiment of the present disclosure, there is suggested to a method for more easily and conveniently disassembling or assembling a ceiling fan.

To this connection, according to an embodiment of the present disclosure, a method for assembling a ceiling fan including a housing cover coupled to an interior ceiling, a plurality of main blades coupled to the housing cover to rotate, and a plurality of sub-blades positioned in blade holes formed in central portions of the plurality of main blades, may include inserting a decoration cover, which defines the hole, into a decoration groove recessed along an incision part formed in an inner surface of the main blade, inserting the main blade into a plurality of blade connectors extending outward from the housing cover, and seating the sub-blade on the top surface of the main blade.

In addition, a plurality of blade connectors may be provided.

In addition, the inserting of the plurality of main blades into the plurality of blade connectors may include inserting any one blade connector into a front connector insertion part formed at an inner front end of the main blade, and inserting another blade connector into a rear connector insertion part formed at an inner rear end of the main blade.

In addition, the sub-blade may include a sub-connector extending corresponding to the blade connector.

In addition, in the sub-connector, the center thereof may be seated on a joint part defined as the coupling part between a plurality of main blades.

Further, the sub-connector and the blade connector may fix a coupling point between the main blades above and below.

In addition, the sub-connector may include a rear corresponding hole and a front corresponding hole formed to be spaced apart from each other in the circumferential direction. The front corresponding hole may be aligned with a front hole of the blade connector in the vertical direction, and the rear corresponding hole may be aligned with a rear hole of the blade connector in the vertical direction.

In addition, the main coupling hole formed in the incision part and the decoration coupling hole formed in the decoration cover may be aligned with each other under the sub-coupling hole formed in one end of the sub-blade.

In addition, the method for assembling the ceiling fan may further include coupling the main coupling hole and the decoration coupling hole by a single coupling member.

According to another aspect, according to an embodiment of the present disclosure, there is suggested the optimal blade shape capable of preventing flow separation of air and minimizing noise and vibration.

To this connection, according to an embodiment of the present disclosure, a ceiling fan may include a shaft coupled to a wall surface in an interior space, a cover to surround the shaft, a main blade coupled to the cover and forcing the flow of the air, a sub-blade positioned in an opening formed in the main blade and force the flow of the air, and a plurality of protrusions formed in the main blade.

In addition, the plurality of protrusions may be formed on a negative pressure surface of the main blade.

In addition, the plurality of protrusions may be formed to be adjacent to the leading edge of the main blade.

Further, the plurality of protrusions may be formed to have sizes different from each other in the radial direction.

Further, the plurality of protrusions may be formed to have sizes increased in the radial direction.

In addition, the main blade may include an incision part formed to have an opening in the shape of being recessed from the inner surface, and the plurality of protrusions may be formed in the extension direction of the main blade from the outer most position of the incision part.

In addition, the main blade may further include a blade fixing part extending from an inner end having an opening to a virtual tangential line drawn at the outer most position of the incision part, a blade assembling part extending from the blade fixing part by a predetermined length, and a blade extension part extending from the wing assembly part to an end thereof.

In addition, the plurality of protrusions may be formed on the blade assembling part and the blade extension part.

In addition, the distance between the plurality of protrusions formed on the blade assembling part and the leading edge may be reduced toward the extension direction.

In addition, the distance between the plurality of protrusions formed on the blade assembling part and the leading edge may be constant toward the extension direction.

In addition, the chord length of the main blade may be reduced in the radial direction.

In addition, the virtual curved line drawn along the upper end of the plurality of protrusions may have the same curvature as the curved line drawn in the extension direction of the main blade.

Further, the main blade may be formed such that the front end in which the leading edge is formed to be shorter than the rear end in which the trailing edge is formed.

According to another aspect, according to an embodiment of the present disclosure, there is suggested the optimal structures of dual blades to improve the wind speed and the air volume in a ceiling fan.

To this connection, according to an embodiment of the present disclosure, the ceiling fan may include a main blade rotating to force the air flow, and a sub-blade positioned in the blade hole which is opening formed along the inner surface of the main blade. The sub-blade may be disposed to have an angle of attack different from that of the main blade.

In addition, the main blade may include an incision part positioned in an inner surface to define a blade hole.

In addition, the front end of the sub-blade may be positioned higher than the incision part, and the rear end of the sub-blade may be positioned lower than the incision part.

In addition, the sub-blade may be positioned such that the front end of the sub-blade is spaced apart from the incision part by the first distance, and the first distance is in the range of 0 mm to 26 mm.

In addition, the sub-blade may be positioned such that the rear end of the sub-blade is spaced apart from the incision part by the second distance, and the second distance is in the range of −10 mm to 10 mm. In this case, the negative (−) sign may be understood as a lower portion of the incision part.

The first distance may be defined as a vertical distance, which is formed between the sub-blade and the incision part at a rear portion, in a vertical distance. Similarly, the second distance may be defined as a vertical distance, which is formed between the sub-blade and the incision part at a front portion, in a vertical distance In addition, the incision part may include a front incision part facing the leading edge of the main blade and a rear incision part facing a trailing edge of the main blade.

In addition, the sub-blade has a front end positioned higher than the front incision end and a rear end positioned lower than the rear incision end.

In addition, the sub-blade is coupled to the main blade and rotates together with the main blade.

In addition, the sub-blade may include a blade plate including a curved surface to guide air, a sub-seating part positioned at one side of the blade plate, and a sub-connector positioned at an opposite side of the blade plate.

In addition the sub-seating part may be seated on the top surface of the main blade. In addition, the sub-seating part may have a sub-coupling hole for coupling to the main blade. In addition, the sub-blade may further include a sub-extension part extending in a curved line from an upper end of the blade plate. In this case, the sub-connector may be formed to protrude forward of the sub-extension part.

In addition, the sub-connector may guide the coupling between the plurality of main blades.

In addition, the sub-connector may be seated on the top surface of the main blade.

Further, the blade plate may be formed to have a camber longer than the camber of the main blade.

Advantageous Effects

According to the present disclosure, the air volume and the flow rate may be more improved due to the dual blades as compared to the conventional ceiling fan. Accordingly, the sense of comfort of the user may be improved.

In addition, the improved air volume and flow rate are provided, thereby rapidly lowering the indoor temperature even in hot weather, and rapidly raising the indoor temperature in cold weather. In other words, the discomfort of the user may be rapidly resolved.

In addition, the circulation of air in the room may be rapidly improved.

In addition, since the air-flow reach range is increased, it is possible to minimize or prevent the stagnation of the air flow in a local space of the room.

In addition, the red zone of the air flow formed under the ceiling fan along the central axis of the ceiling fan is minimized, thereby providing the uniform and constant sense of comfort to the user.

Further, the uniform air flow rate and temperature distribution may be formed in the whole indoor space.

Accordingly, the sense of comfort may be provided to the user to the same extent regardless of the positions of the user.

In addition, the circulation ability of the air in the room is improved, thereby minimizing the difference between the operation of the fan and the sensible temperature of the user. In other words, the satisfaction of the product may be improved.

Further, the vibration and the noise of the ceiling fan are minimized, thereby improving the quietness and stability of a product.

Further, the ceiling fan may be easily assembled or disassembled, so the installation convenience, manageability, and transportability of the product may be improved.

In addition, the coupling point (contact point) between the main blades may be fixed and supported by the sub-blade and the housing cover below and above. Accordingly, the bending moment applied to the main blade may be reduced.

Accordingly, since the main blade may be prevented from being warped due to the repeated rotation thereof and the gravity, the lifespan of the product may be improved.

In addition, the coupling portion between two blades has greater coupling force because the central portions of the sub-connector and the blade connector cross each other in the vertical direction. Accordingly, the coupling and the decoupling may be prevented due to the repeated rotation of the ceiling fan.

In addition, since the housing cover, the main blade, and the sub-blade are coupled to each other while being chained with each other, the stable rotation is possible. Accordingly, the vibration to be caused by the rotation of the ceiling fan may be minimized.

In addition, the flow separation caused on the negative pressure surface of the blade may be minimized.

Further, the noise of the ceiling fan may be minimized by preventing the flow separation of the air. In other words, quietness of the product may be more improved.

In addition, since the blade hole and the sub-blade are provided to force air to flow at the central portion in which the air flow is stagnant, the maximum air volume supplied by the product may be improved.

Further, since there are suggested the optimal height, size, shape, and angle of the sub-blade having angles of attack different from an angle of attack of the main blade to improve the volume of sucked air, the wind speed and the air volume of the ceiling fan may be optimized.

In addition, the improved air volume may be provided and the power consumption may be reduced. Accordingly, an economical product may be provided.

BEST MODE

Mode for Invention

Figure 1:
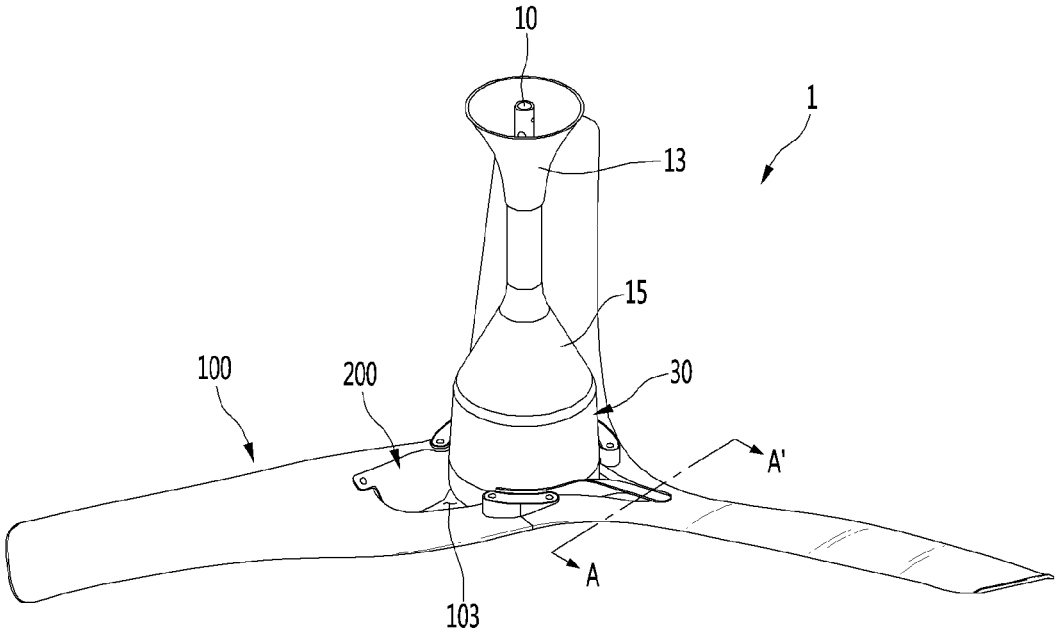
FIG. 1 is a perspective view illustrating a ceiling fan according to an embodiment of the present disclosure.

Hereinafter, some embodiments of the present disclosure will be described in detail with reference to accompanying drawings. In the following description, the same reference numerals will be assigned to the same components even though the components are illustrated in different drawings. In addition, in the following description of an embodiment of the present disclosure, a detailed description of well-known features or functions will be ruled out in order not to unnecessarily obscure the gist of the present disclosure.

In the following description of components according to an embodiment of the present disclosure, the terms 'first', 'second', 'A', 'B', '(a)', and '(b)' may be used. The terms are used only to distinguish relevant components from other components, and the nature, the order, or the sequence of the relevant components is not limited to the terms. When a certain component is "linked to", "coupled to", or "connected with" another component, the certain component may be directly linked to or connected with the another component, and a third component may be "linked", "coupled", or "connected" between the certain component and the another component.

FIG. 1 is a perspective view illustrating a ceiling fan according to an embodiment of the present disclosure.

Referring to FIG. 1, according to an embodiment of the present disclosure, a ceiling fan 1 may include covers 13,15, 30, and 90, and a plurality of blades 100 and 200 which are rotatable to allow air to forcibly flow.

The plurality of blades 100 and 200 may include a main blade 100 and a sub-blade 200 positioned in a space formed inside the main blade 100.

The main blade 100 may be formed to extend in a radial direction about the axis of rotation.

In this case, the axis of rotation is the same as the central axis of the covers 13, 15, 30, and 90. In addition, the shafts 10 and 20 to be described below are provided to extend along the central axis of the covers 13, 15, 30, and 90. Accordingly, the axis of rotation may be understood as being the central axis of the ceiling fan 1. Hereinafter, the axis of rotation may be referred to as "central axis".

In addition, an inner surface of the main blade 100 may be defined as a lateral side facing the central axis.

Accordingly, an outer surface of the main blade 100 may be defined as a lateral side which is opposite to the inner surface and faces the radial direction.

Meanwhile, the front and rear portions may be defined based on forward rotation that the blades 100 and 200 of the ceiling fan 1 rotate clockwise. For example, the main blade 100 has a leading edge 127 formed on a front surface facing the front portion and a trailing edge 128 formed on a rear surface facing the rear portion, when viewed based on the rotation direction.

The main blade 100 may extend by a predetermined length in the radial direction perpendicular to the central axis.

A plurality of main blades 100 may be provided. In this case, the following description will be made while focusing on the ceiling fan 1 including three main blades 100 for the convenience of explanation, according to an embodiment of the present disclosure. In this case, the number of the main blades 100 is not limited thereto.

Inner ends of the main blades 100 may be connected with each other to be in contact with each other. In addition, a space may be formed at the center of the plurality of main blades 100. The covers 13, 15, 30, and 90 and the sub-blade 200 may be positioned in the space.

In detail, the main blade 100 may have a blade hole 103 in which the sub-blade 200 is positioned. For example, the blade hole 103 may be formed by cutting away the inner surface of the main blade 100 such that the inner surface is rounded in the radial direction.

In summary, a blade hole 103 is formed inside the main blade 100 and open in the vertical direction, and the sub-blade 200 may be positioned in the blade hole 103.

A plurality of sub-blades 200 may be provided corresponding to the number of the main blades 100. The following description will be made while focusing on the ceiling fan 1 including three sub-blades 200 for the convenience of explanation, according to an embodiment of the present disclosure.

The sub-blade 200 may rotate together with the main blade 100. For example, when the main blade 100 rotates clockwise to perform the forward rotation, the sub-blade 200 rotates clockwise together with the main blade 100.

The air in the central area of the ceiling fan 1 may forcibly flow through the blade hole 103 by the rotation of the sub-blade 200.

The ceiling fan 1 may cause the flow of the air by rotating the dual blades 100 and 200. Accordingly, the air volume and the flow rate provided by the ceiling fan 1 are more increased. In addition, the space, in which the air flow rate becomes lowered, is minimized in the room, thereby improving air circulation and maximizing interior air-conditioning space.

Figure 2:
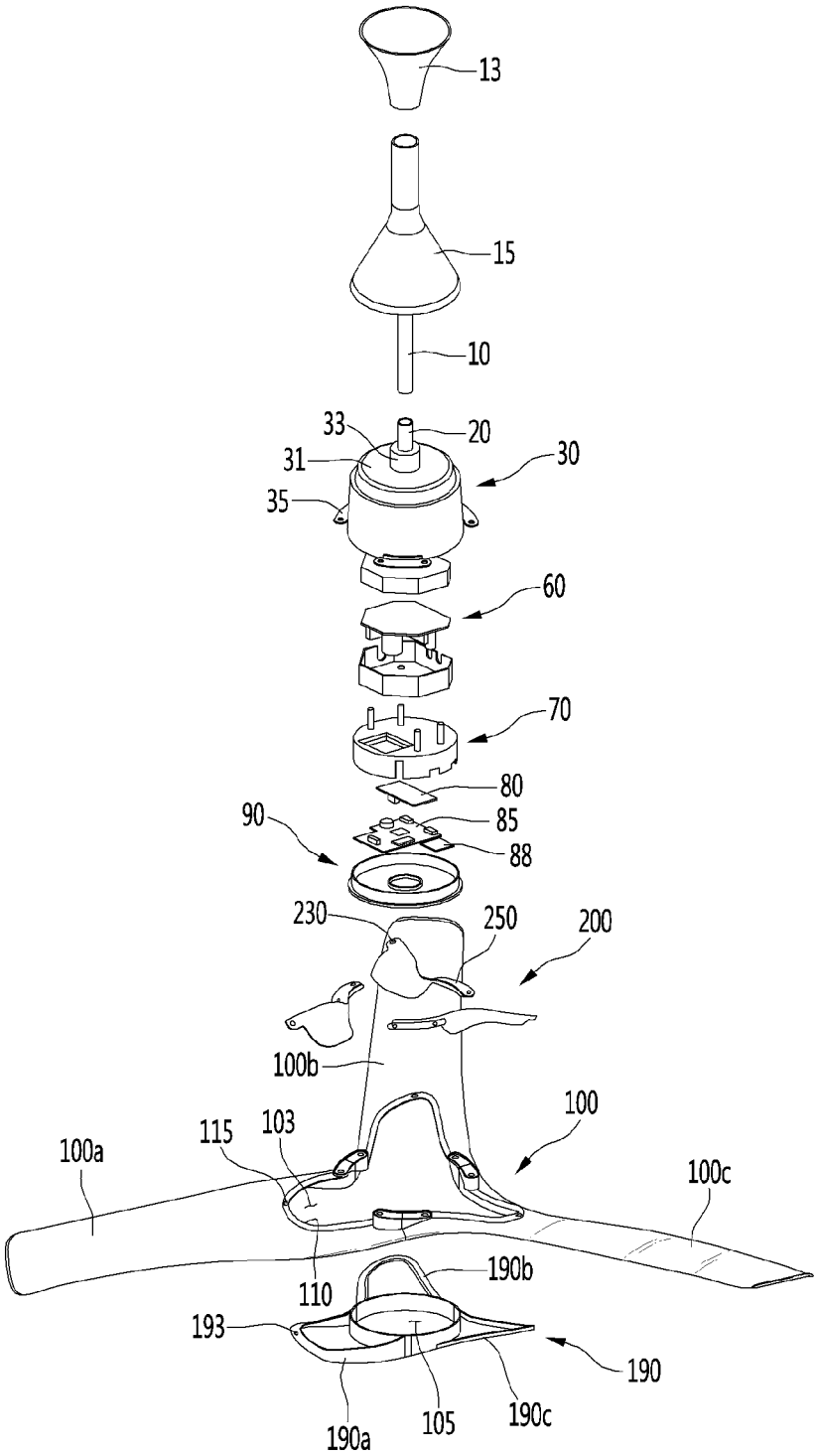
FIG. 2 is an exploded perspective view of the ceiling fan according to an embodiment of the present disclosure.

FIG. 2 is an exploded perspective view of the ceiling fan according to an embodiment of the present disclosure.

Referring to FIG. 2, the ceiling fan 1 according to an embodiment of the present disclosure may include a shaft 10 coupled to a ceiling or wall surface, and an upper cover 13 and a lower cover 15 to cover an outer portion of the shaft 10.

The upper cover 13 and the lower cover 15 may protect the shaft 10 from being exposed to the outside.

An upper end of the upper cover 13 makes contact with the ceiling or the wall surface and a lower end of the upper cover 13 is coupled to an upper end cover of the lower cover 15. For example, the upper cover 13 may be provided in the form of a funnel.

The lower cover 15 is coupled to a lower portion of the upper cover 13. In addition, the lower cover 15 may be formed integrally with the upper cover 13.

The upper end of the lower cover 15 may extend in the same direction of the extending direction of the shaft 10. In addition, the lower cover 15 may extend such that the inner diameter of the lower cover 15 is increased downward. For example, the lower cover 15 may be formed in a conical shape.

The lower cover 15 may cover an upper portion of a housing cover 30 to be described below. In addition, the lower cover 15 may be positioned to be spaced apart outward from the housing cover 30 by a predetermined distance.

The shaft 10 may be coupled to the ceiling or wall surface to provide fixing force. For example, the shaft 10 may be coupled to a predetermined coupling device provided on the concrete wall surface of the ceiling. Accordingly, a plurality of components coupled to the lower portion of the shaft 10 may be firmly fixed and supported.

The ceiling fan 1 may further include a motor shaft 20 coupled to the lower end of the shaft 10 and the housing cover 30 to cover an outer portion of the motor shaft 20.

The motor shaft 20 and the shaft 10 may be integrally coupled to each other to form the central axis of the ceiling fan 1. In addition, the motor shaft 20 is coupled to the shaft coupled to the ceiling, so a plurality of components coupled to the motor shaft 20 may be fixed.

The motor shaft 20 passes through the center of the housing cover 30 to extend downward. In other words, the motor shaft 20 may be positioned on the central axis of the housing cover 30.

The housing cover 30 may form an internal space to receive a plurality of parts therein. The plurality of parts may include a motor assembly a bridge support, a control assembly 60, a bridge case 80, and a display cover 90.

The housing cover 30 may have openings extending in a vertical direction. Accordingly, the motor shaft 20 may be positioned to be inserted into the upper portion of the housing cover 30 in the direction of the central axis, and the display cover 90 may be positioned to be spaced apart inward from the lower end of the housing cover 30.

The housing cover 30 may include a cylindrical shape having top and bottom surfaces that are open. The housing cover 30 may extend such that the diameter of the housing cover 30 is gradually increased downward. In other words, an outer circumferential surface of the housing cover 30 may be expanded to the outside downward.

The housing cover 30 may include a blade connector 35 inserted into the main blade 100.

The blade connector 35 may be formed to protrude outward from the outer circumferential surface of the housing cover 30. For example, the blade connector 35 may be formed to extend in a radial direction from the lower end of the housing cover 30.

The blade connector 35 may guide a plurality of main blades 100 such that the plurality of main blades 100 are connected with or coupled to the blade connector 35. To this end, the blade connector 35 may have a plurality of coupling holes.

Alternatively, the blade connector 35 may be formed corresponding to the number of the main blades 100. For example, when three main blades 100 are coupled to each other, three blade connectors 35 may be provided.

In this case, the blade connectors 35 may be arranged to have included angles equal to included angles formed among the three main blades 100 in a circumferential direction about the central axis.

In addition, the blade connector 35 is positioned at a point in which the two main blades 100 are coupled to each other, and the blade connector 35 may be inserted into each main blade 100.

The housing cover 30 may be positioned to be spaced apart downward from the lower end of the lower cover 15 by a predetermined distance.

In addition, the upper end of the housing cover 30 may be formed to have a diameter equal to a diameter of the lower end of the lower cover 15. Accordingly, the lower cover 15 and the housing cover 30 may provide a sense of unity and uniformity in the outer appearance.

In addition, the housing cover 30 may include a cover insertion part 31 positioned to be spaced apart inward from the lower end of the lower cover 15 by a predetermined distance.

The cover insertion part 31 may constitute the upper portion of the housing cover 30. In addition, the cover insertion part 31 may extend such that the inner diameter of the cover insertion part 31 is reduced upward from the upper end of the housing cover 30. For example, the cover insertion part 31 may extend to be rounded upward. In other words, the cover insertion part 31 may be provided in a bowl form.

The cover insertion part 31 has a diameter smaller than the diameter of the upper end of the housing cover 30, so the cover insertion part 31 may be inserted into the lower cover 15.

Accordingly, since the housing cover 30 coupled to the blades 100 and 200 is disposed to be spaced apart from the lower cover 15 fixed to the ceiling, the mutual interference and vibration caused by the rotation of the blades 100 and 200 may be avoided.

In addition, the motor shaft 20 is prevented from being viewed from the outside, thereby providing a simple and neat ceiling fan 1 for a user.

The cover insertion part 31 may include a shaft connection part 33 allowing the motor shaft 20 to pass therethrough and to be positioned.

The shaft connection part 33 may have a hole that is open in the vertical direction and may be positioned at the center of the cover insertion part 31. For example, the shaft connection part 313 may extend upward from one surface of the cover insertion part 31. For example, the cover insertion part 33 may be provided in the form of a ring.

Accordingly, the motor shaft 20 may be inserted into the center of the cover insertion part 31. Accordingly, the motor shaft 20 may be positioned on the central axis of the housing cover 30.

The ceiling fan 1 may further include a motor assembly (not illustrated) to provide rotation power to the blades 100 and 200, a bridge support (not illustrated) coupled to the motor shaft 20 to expand a static installation space downward, and a control assembly 60 positioned under the bridge support 50.

The motor assembly and the bridge support may be positioned in an internal space of the housing cover 30. In addition, the motor assembly and the bridge support may be coupled to the motor shaft 20.

The motor assembly may include an outer type of a motor. Accordingly, a stator of the motor may be coupled to and fixed to the motor shaft 20, and a rotor of the motor may be positioned outside the stator to rotate.

In addition, the housing cover 30 may be coupled to the rotor. Accordingly, the housing cover 30 may rotate together with the rotor.

The bridge support (not illustrated) may be coupled to and fixed to the lower end of the motor shaft 20.

The control assembly 60 may include a case and a main PCB. In addition, a plurality of electronic components may be provided in the control assembly 60 to perform the function of a control unit of the ceiling fan 1.

The ceiling fan 1 may further include a bridge case 70 positioned under the control assembly 60 and a display cover 90 positioned under the bridge case 70.

The bridge case 70 may be coupled to the bridge support and the control assembly 60. Accordingly, the bridge case 70 may be fixed to a lower portion of the control assembly 60 to support the control assembly 60.

In other words, the control assembly 60 may be positioned between the bridge case 70 and the bridge support.

The display cover 90 may be coupled to a lower portion of the bridge case 70. In addition, electronic components performing various functions may be disposed in the display cover 90 and the bridge case 70.

The display cover 90 may be positioned at the lower most central portion of the ceiling fan 1 to form a bottom surface of an outer portion of the ceiling fan. In addition, the display cover 90 may provide visual information for the user positioned on the ground surface.

In addition, the display cover 90 may be positioned at a static position defined as a non-rotation position, instead of rotating together with the rotation of the blades 100 and 200, so the visibility of the user is improved.

The ceiling fan 1 may further include an anti-bug module to eliminate a pest, a display module 85 to perform a lighting function, and a communication module 88 to perform a communication function.

The anti-bug module 80, the display module 85, and the communication module 88 may be positioned in an internal space formed by the display cover 90 and the bridge case 70.

The display module 85 may include a lamp (LED) to provide a light and a display PCB to control the lamp.

The communication module 88 may include Wi-Fi.

The ceiling fan 1 may further include the main blade 100 and the sub-blade 200 to receive power and to rotate.

A plurality of main blades 100 may be provided. For example, the main blade 100 may include a first main blade 100*a*, a second main blade 100*b*, and a third main blade 100*c*.

The first to third main blades 100*a*, 100*b*, and 100*c* may have the same structure. The first to third main blades 100*a*, 100*b*, and 100*c* may be provided to be coupled or assembled together at opposite ends thereof.

The first to third main blades 100*a*, 100*b*, and 100*c* may be coupled to each other to be integrated.

In this case, the first to third main blades 100*a*, 100*b*, and 100*c* integrally coupled to each other may have holes 103 and 105 open in the vertical direction, at the centers thereof. For example, the holes 103 and 105 may have the form of a roly-poly.

The spaces of the holes 103 and 105 may be divided by the decoration cover 190. In detail, the holes 103 and 105 may be divided into a center hole 105 at which the display cover 90 is positioned and a blade hole 103 positioned at which the sub-blade 200, by a decoration cover 190.

The first to third main blades 100*a*, 100*b*, and 100*c* may be arranged to form a predetermined angle between adjacent main blades based on the central axis while longitudinally extending in the radial direction. For example, the predetermined angle may be 120°.

The first to third main blades 100*a*, 100*b*, and 100*c* may be coupled or assembled together at opposite ends thereof.

The main blade 100 may be formed therein with a main coupling hole 115 to be coupled to the sub-blade 200. The main coupling hole 115 may include a hole to be coupled to a coupling member.

The main coupling hole 115 may be positioned in the top surface (negative pressure surface) of the main blade 100. For example, the main coupling hole 115 may be formed at one point of an incision part 110 defining the blade hole 103.

The incision part 110 may be formed to have the shape that the inner surface of the main blade 100 is recessed in the radial direction. Accordingly, the incision part 110 may form an inner-surface edge of the main blade 100.

The main blade 100 may include the decoration cover 190.

The decoration cover 190 may be inserted into the inner surface of the main blade 100. In addition, a plurality of decoration covers 190 may be provided corresponding to the main blade 100. For example, the decoration cover 190 may include a first decoration cover 190*a* inserted into the first main blade 100*a*, a second decoration cover 190*b* inserted into the second main blade 100*b*, and a third display cover 190*c* inserted into the third main blade 100*c*.

The plurality of decoration covers 190 may be coupled to each other while relying on the plurality of main blades 100. In other words, when the first to third main blades 100*a*, 100*b*, and 100*c*, which are separated from each other, are coupled to each other to be integrated, the first to third decoration covers 190*a*, 190*b*, and 190*c* inserted into the first to third main blades 100*a*, 100*b*, and 100*c* depend on the coupling of the first to third main blades 100*a*, 100*b*, and 100*c* to be integrated.

In addition, the center of the decoration cover 190 integrally formed may form the center hole 105. In addition, a plurality of blade holes 103 may be positioned outside the center hole 105.

The decoration cover 190 may include a decoration coupling hole 193 corresponding to the main coupling hole 115. The decoration coupling hole 193 may be positioned vertically under the main coupling hole 115.

A single coupling member may be inserted into the decoration coupling hole 193 and the main coupling hole 115.

The sub-blade 200 may be positioned in the blade hole 103. The sub-blade 200 may extend with a predetermined curvature.

In addition, the sub-blade 200 may be arranged to have an inclined angle different from that of the main blade 100. For example, the sub-blade 200 may include an extension surface to guide air to have an angle of attack different from that of the main blade 100

A plurality of sub-blades 200 may be provided corresponding to the number of the main blades 100.

The sub-blade 200 may include a sub-coupling hole 230 to couple the main blade 100 and the decoration cover 190.

The sub-coupling hole 230 may be positioned to correspond to the main coupling hole 115 when the sub-blade 200 is mounted in the main blade 100.

Accordingly, a coupling member inserted into the sub-coupling hole 230 may be coupled by passing through both a decoration coupling hole 193 and the main coupling hole 115.

The sub-coupling hole 230 may be formed in one end of the sub-blade 200. In addition, the sub-coupling hole 230 may be formed such that the sub-coupling hole 230 is seated above the main coupling hole 115.

In summary, when the sub-coupling hole 230 is coupled to the main blade 100, the sub-coupling hole 230 may be positioned to be aligned in line with the main coupling hole 115 and the decoration coupling hole 193.

The sub-blade 200 may include a sub-connector 250 to support the coupling between the plurality of main blades 100.

The sub-blade 200 may be disposed to correspond to the blade connector 35 in the vertical direction, and may be placed at the coupling point between the plurality of main blades 100.

The sub-connector 250 may be formed at an opposite end of the sub-blade 200. For example, the sub-connector 250 may extend in the shape corresponding to that of the blade connector 35.

In addition, the sub-connector 250 may be seated at a position at which two main blades 100 are coupled to each other. For example, the sub-connector 250 may be seated at a position at which the first main blade 100*a* and the second main blade 100*b* are coupled to each other.

In addition, the sub-connector 250 may be formed therein with holes corresponding to a plurality of holes formed in the blade connector 35.

In other words, when the housing cover 30, the sub-blade 200, and the main blade 100 are coupled to each other, the sub-connector 250 and the blade connector 35 are disposed in the vertical direction and aligned such that the holes communicate with each other.

Similarly, a front connector hole 146 and a rear connector hole 156, which are aligned to communicate with the hole of the sub-connector 250, may be formed in the two main blades 100 coupled to each other, when the housing cover 30, the sub-blade 200, and the main blade 100 are coupled to each other.

Accordingly, when the sub-connector 250 is seated on the two coupled main blades 100, the coupling member may pass through the hole of the sub-connector 250 and may pass through the front connector hole 146 or the rear connector hole 156. In addition, the coupling member may be inserted into and coupled to the coupling hole of the blade connector 35.

A plurality of sub-blades 200 may be provided corresponding to the number of the main blades 100. For example, the sub-blade 200 may include a first sub-blade positioned in the blade hole 103 formed inside the first main blade 100*a*, a second sub-blade positioned in the blade hole 103 formed inside the second main blade 100*b*, and a third sub-blade positioned in the blade hole 103 formed inside the third main blade 100*c*.

Meanwhile, the control assembly 60, the bridge case 70, the display cover 90, and a plurality of modules 80, 82, and 88 may be defined as an electronic unit. In other words, the electronic unit may be understood as the feature of the ceiling fan 1 in which a plurality of electronic components are installed.

The electronic unit may be positioned in the internal space of the housing cover 30 and may be coupled to the lower portion of the motor shaft 20. Accordingly, the electronic unit may be stably fixed by the coupling force transmitted from the ceiling.

Meanwhile, an outer appearance of the ceiling fan 1 are simple and uniform because the ceiling fan 1 is provided such that only the upper cover 13, the lower cover 15, the housing cover 30, the display cover 90, the main blade 100, and the sub-blade 200 are exposed to the outside, thereby providing the esthetic sense for the user.

Figure 3:
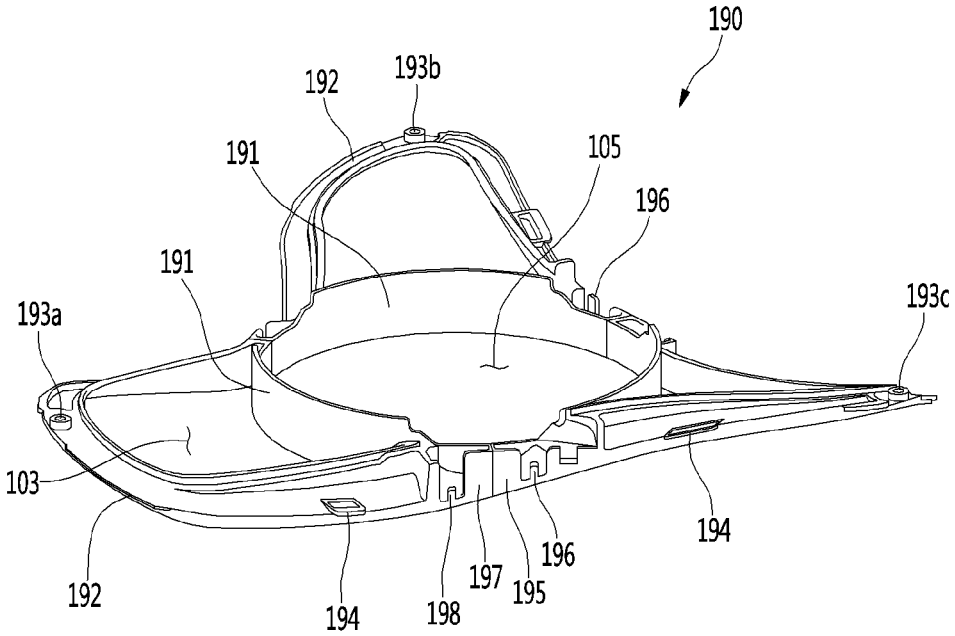
FIG. 3 is a perspective view illustrating a decoration cover according to an embodiment of the present disclosure.

FIG. 3 is a perspective view illustrating a decoration cover according to an embodiment of the present disclosure.

In addition, a plurality of decoration covers 190 may be provided corresponding to the main blades 100. The display covers 90 may be coupled to each other.

For example, when three main blades 100 are provided, the decoration cover 190 may include a first decoration cover 190*a* inserted into the first main blade 100*a*, a second decoration cover 190*b* inserted into the second main blade 100*b*, and a third display cover 190*c* inserted into the third main blade 100*c*.

The first to third decoration covers 190*a*, 190*b*, and 190*c* may have the same structure.

The decoration cover 190 may include a partition plate 191, which is rounded while extending inward, to partition a center hole 105 from a blade hole 103 and a blade insertion part 192 extending from the partition plate 191 to define the blade hole 103.

The partition plate 191 may be formed in a curved surface extending with a predetermined curvature. In addition, the partition plate 191 may extend to be convex toward the blade insertion part 192.

When the plurality of decoration covers 190 are coupled to each other to be integrated, partition plates 191 may be coupled to each other in a ring shape. In this case, the partition plates 191 coupled to each other may define the center hole 105 serving as the center space.

The blade insertion part 192 may be formed to protrude outward from the partition plate 191. In detail, the blade insertion part 192 may extend in a radial direction from the partition plate 191 based on the central axis to form a ring shape. For example, the blade insertion part 192 may extend to link ends of the partition plate 191 in a ring shape.

In other words, the blade insertion part 192 may extend from a front end of the partition plate 191 to a rear end of the partition plate 191 to form a surrounding space together with the outer circumferential surface of the partition plate 191.

In this case, the space surrounded by the blade insertion part 192 and the partition plate 191 may be understood as the blade hole 103. In other words, the blade hole 103 may be defined along the blade insertion part 192 and the inner circumference of the partition plate 191.

The blade insertion part 192 may extend in a ring shape. Accordingly, the blade insertion part 192 may extend to be bent several times. For example, the blade insertion part 192 may be formed in a C shape, a substantial C shape, or a ring shape.

The blade insertion part 192 may include a front contact part 195 mounted on an inner front end of the main blade 100 and a rear contact part 197 mounted on an inner rear end of the main blade.

The front contact part 195 may be positioned a front end of the blade insertion part 192. In addition, the front contact part 195 may be formed to be coupled to the front end of the partition plate 191. For example, the front contact part 195 may be formed to be integrally coupled to the front end of the partition plate 191.

The front contact part 195 may be mounted on the inner surface of a front decoration groove 135 to be described below such that the front contact part 195 is engaged with the front decoration groove. In other words, the outer surface of the front contact part 195 may have a shape corresponding to the inner surface of the front decoration groove 135.

The front contact part 195 may be inserted into and coupled to the front decoration groove 135 of the main blade 100. Accordingly, the front contact part 195 may include a front snap device 196 for the coupling with the main blade 100.

The front snap device 196 may be understood as a device coupled to the front decoration groove 135. In addition, the front snap device 196 may be formed to be elastically deformed. The front snap device 196 may include a snap fit. For example, the front snap device 196 is engaged with a groove by recessing an inner surface of the front decoration groove 135 in a press-fitting scheme.

The rear contact part 197 may be positioned a rear end of the blade insertion part 192. In addition, the rear contact part 197 may be formed to be coupled to the rear end of the partition plate 191. For example, the rear contact part 197 may be formed to be integrally coupled to the rear end of the partition plate 191.

The rear contact part 197 may be mounted on the inner surface of a front decoration groove 133 to be described below. In other words, the outer surface of the rear contact part 197 may have a shape corresponding to the inner surface of the rear decoration groove 133.

The rear contact part 197 may be inserted into and coupled to the rear decoration groove 133 of the main blade 100. Accordingly, the rear contact part 197 may include a rear snap device 198 for the coupling with the main blade 100.

The rear snap device 198 may be understood as a device coupled to the rear decoration groove 133. In addition, the front snap device 198 may be formed to be elastically deformed. The rear snap device 198 may include a snap fit. For example, the rear snap device 198 is engaged with a groove formed by recessing an inner surface of the rear decoration groove 133 in a press-fitting scheme.

Meanwhile, when the plurality of main blades 100 are assembled, that is, when the decoration covers 190 mounted on the main blades 100, the front contact part 195 provided any one decoration cover 190 may be coupled to another rear contact part 197 to be in contact with the rear contact part 197.

In addition, a device to guide the coupling between the front contact part 195 and the rear contact part 197 may be provided on the contact surface between the front contact part 195 and the rear contact part 197.

The blade insertion part 192 may further include a plurality of blade coupling grooves 194 to guide the stable fixing and coupling as the blade insertion part 192 is inserted into the main blade 100.

The blade coupling groove 194 may guide the coupling of a locking protrusion (not illustrated) formed in the decoration groove 130 of the main blade 100. The blade coupling groove 194 may be formed as a groove formed by recessing downward from the top surface of the blade insertion part 192.

The plurality of blade coupling grooves 194 may be formed at positions corresponding to a plurality of locking protrusions (not illustrated) formed on the decoration grooves 130 of the main blade 100. Accordingly, the blade coupling groove 194 may guide the locking protrusion as the locking protrusion is inserted or fitted such that the decoration cover 190 is stably mounted in the main blade 100.

Figure 4:
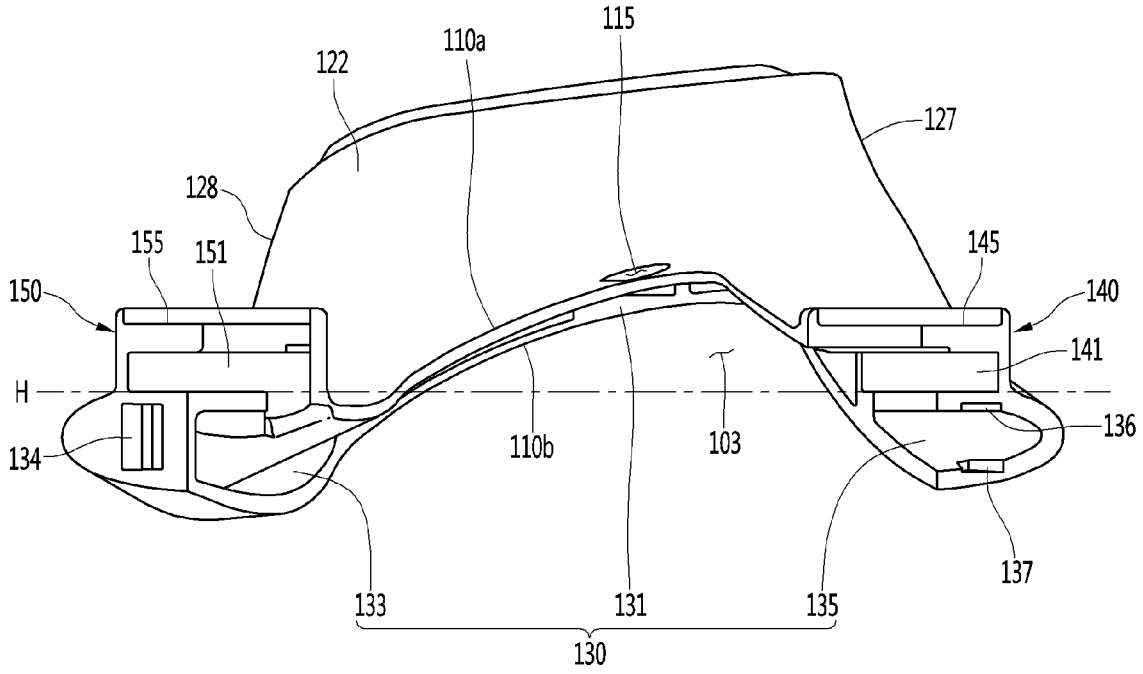
FIG. 4 is a side view of the main blade viewed from the inside according to an embodiment of the present disclosure.

The decoration cover 190 is inserted into the main blade 100 to correspond to the inclination angle of the main blade 100 forming a positive pressure surface 121 (see FIG. 4) and a negative pressure surface 122 (see FIG. 4).

In detail, the blade insertion part 192 may extend to be inclined downward toward the rear portion thereof.

Accordingly, the blade insertion part 192 may be inserted into and engaged with the inner surface of the main blade 100 having the inclination.

The decoration cover 190 may include a decoration coupling hole 193 formed to correspond to the main coupling hole 115.

The decoration coupling hole 193 may be located at the blade insertion part 192. For example, the decoration coupling hole 193 may be formed as an upwardly open hole in the outer top surface of the blade insertion part 192.

When the decoration cover 190 is inserted into the main blade 100, the decoration coupling hole 193 may be positioned vertically under the main coupling hole 115. In addition, the decoration coupling hole 193 and the main coupling hole 115 may be coupled to each other as a single coupling member is inserted into the decoration coupling hole 193 and the main coupling hole 115.

According to another aspect, the blade insertion part 192 may include two extension plates extending by a predetermined distance outward from opposite ends of the partition plate 191 and a bending plate formed by bending and extending the two extension plates from the opposite ends and connecting two extension plates to each other.

In this case, the bending plate is spaced apart outward from the partition plate 191 and rounded with a predetermined curvature along the extension direction of the partition plate 191.

Figure 5:
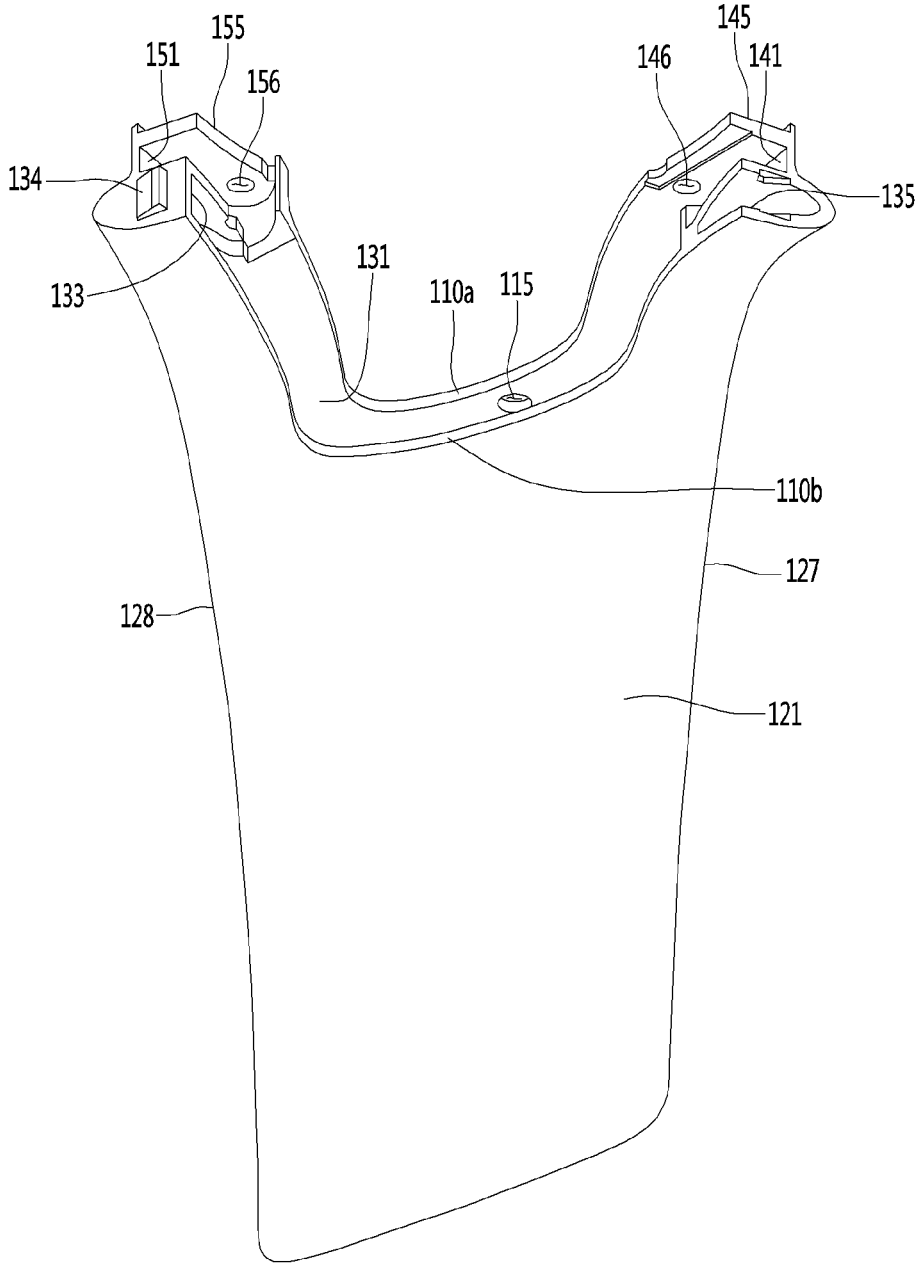
FIG. 5 is a perspective view of the main blade viewed from the bottom according to an embodiment of the present disclosure.

FIG. 4 is a side view of the main blade viewed from the inside according to an embodiment of the present disclosure and FIG. 5 is a perspective view of the main blade viewed from the bottom according to an embodiment of the present disclosure.

The top surface of the main blade 100 is defined as a negative pressure surface 122 and the bottom surface of the main blade 100 defined as a positive pressure surface 121.

Referring to FIGS. 4 to 5, the main blade 100 may include an incision part 110 having an opening formed in an inner surface thereof.

The incision part 110 may be formed by cutting the inner surface of the main blade 100 such that the blade hole 103 having a recess shape is formed.

In other words, the incision part 110 may extend to have a shape of being recessed in a radial direction of opposite ends of the main blade 100, which are coupled to different main blades 100. For example, the incision part 110 may be formed to have the C shape.

The decoration cover 190 may be inserted into the space in which the incision part 110 is formed. Accordingly, the blade hole 103 may be defined by the incision part 110.

A virtual horizontal line bisecting the incision part 110 in the forward and backward directions when viewed from the horizontal plane may pass through the center of the incision part 110. The center of the incision part 110 may be positioned to be closed to a winglet 160 positioned at an outer end of the main blade 100.

The incision part 110 may include an upper incision part **110*a* formed on the negative pressure surface 112 and a lower incision part 110*b* formed on the positive pressure surface 121**.

The main coupling hole 115 may be formed in the incision part 110. In detail, the main coupling hole 115 may be formed in the upper incision part **110*a*. In addition, the main coupling hole 115 may be formed to be positioned in front of the center of the incision part 110**.

The main blade 100 may further include a decoration groove 130, in which the decoration cover 190 is inserted, along the inner surface thereof.

The decoration groove 130 may be formed between the upper incision part 110*a* and the lower incision part 110*b*. In detail, the decoration groove 130 may be formed by recessing the inner surface in the radial direction between the upper incision part 110*a* and the lower incision part 110*b*.

The decoration groove 130 may include a rear decoration groove 133 formed toward a trailing edge 128, a decoration insertion groove 131 formed corresponding to the extending direction of the incision part 110, and a front decoration groove 135 formed toward the leading edge 127.

The rear decoration groove 133 may be positioned at a rear end of an inner surface of the main blade 100, and the front decoration groove 135 may be positioned at a front end of the inner surface of the main blade 100.

The main blade 100 may be provided in the form of a curved surface such that the leading edge 127 is higher than the trailing edge 128. The rear decoration groove 133 in which one side of the decoration cover 190 is mounted may be formed to be positioned lower than the front decoration groove 135 in which an opposite side of the decoration cover 190 is mounted.

In decoration cover 190 may extend corresponding to the longitudinal section of the main blade 100.

The rear decoration groove 133 may be formed with a groove or a space engaged with a rear contact part 197 formed at one end of the decoration cover 190. A locking protrusion (not illustrated) coupled to the rear snap device 198 may be formed in the rear decoration groove 133.

The front decoration groove 135 may be formed with a groove or a space engaged with a front contact part 195 formed at an opposite end of the decoration cover 190. A locking protrusion (not illustrated) coupled to the front snap device 196 may be formed in the front decoration groove 135.

The decoration insertion groove 131 may be formed between the upper incision part 110*a* and the lower incision part 110*b*. In addition, the decoration insertion groove 131 may have a groove or a space to be recessed in the radial direction by a predetermined length along the inner surface of the main blade 100 or the extension direction of the main blade 100.

The decoration insertion groove 131 may include a locking protrusion coupled or locked to the blade coupling groove 194.

The main blade 100 may further include a front coupling part 140 and a rear coupling part 150 in which the housing cover 30 and the sub-blade 200 are mounted.

In addition, the front coupling part 140 and the rear coupling part 150 may include connector insertion parts 141 and 151, in which the housing cover 30 is mounted, and connector seating parts 145 and 155 in which the sub-blade 200 is mounted.

The front coupling part 140 may be formed at an upper end of the inner surface in which the front decoration groove 135 is formed.

The rear coupling part 150 may be formed at an upper end of the inner surface in which the rear decoration groove 133 is formed.

The upper end of the inner surface in which the rear decoration groove 133 is formed and the upper end of the inner surface, in which the front decoration groove 135 is formed, may be positioned horizontally at the same plane.

Accordingly, there may be defined a virtual horizontal line H, which is drawn from the upper end of the inner surface, in which the rear decoration groove 133 is formed, to the upper end of the upper end of the inner surface in which the front decoration groove 135 is formed.

The front coupling part 140 and the rear coupling part 150 may be formed to extend upward from the top surface of the main blade 100.

In detail, the front coupling part 140 may vertically extend from the inner rear end of the negative pressure surface 122. In detail, the rear coupling part 150 may vertically extend from the inner front end of the negative pressure surface 122.

When a plurality of main blades 100 are coupled or assembled together, the front coupling part 140 may be coupled to the rear coupling part 150 of another main blade 100.

Accordingly, the inner surface of the front coupling part 140 may be formed in the shape corresponding to the shape of the inner surface of the rear coupling part 150.

The front coupling part 140 and the rear coupling part 150 may extend to have the same height based on the horizontal line H.

Accordingly, the housing cover 30 may be formed to be asymmetrical, so the main blade 100 may be easily installed.

In addition, when a plurality of sub-blades 200 and a plurality of main blades 100 are coupled, angles between the sub-blades 200 and the main blades 100 may be set to be equal to each other.

The front coupling part 140 may include a front connector insertion part 141, in which the blade connector 35 of the housing cover 30 is inserted, and a front connector seating part 145 in which a sub-connector 250 of the sub-blade 200 is seated.

The front connector insertion part 141 may be formed as a groove corresponding to the shape of the blade connector 35. For example, the front connector insertion part 141 may extend in the circumferential direction to draw an arc based on the central axis of the ceiling fan 1 described above.

The front connector insertion part 141 may be formed by recessing the inner surface in which the incision part 110 is formed. For example, the inner circumferential surface of the front connector insertion part 141 may have the section in the substantial C shape.

When a plurality of main blades 100 are integrally coupled or assembled together, the front connector insertion part 141 may be coupled to the rear connector insertion part 151 of another main blade 100.

In addition, the front connector insertion part 141 and the rear connector insertion part 151, which are connected with each other, may form a groove or a space in which any one blade connector 35 is inserted. Accordingly, the front connector insertion part 141 and the rear connector insertion part 151 may be formed to be positioned at the same height.

The front connector seating part 145 may be positioned above the front connector insertion part 141.

The front connector seating part 145 may be positioned at an upper portion of the front connector insertion part 141. The front connector seating part 145 may be formed on the top surface of the front connector insertion part 141.

The front connector seating part 145 may extend in the circumferential direction to correspond to the extension direction of the front connector insertion part 141.

A front connector hole 146, which is bored downward, may be formed in the front connector seating part 145. For example, when the housing cover 30, the main blade 100, and the sub-blade 200 are coupled together, the front connector hole 146 may be positioned to be matched with holes 36 and 37 formed in the blade connector 35 and holes 255 and 256 formed in the sub-connector 250 in the central axis.

In other words, the front connector hole 146 may be formed at a position vertically aligned with holes formed in the blade connector 35 and the sub-connector 250.

When the plurality of main blades 100 are integrally coupled or assembled, the front connector seating part 145 is coupled to a rear connector seating part 155 of another main blade 100 to form a surface in which any one sub-connector 250 is seated.

The rear coupling part 150 may include a rear connector insertion part 151, in which the blade connector 35 of the housing cover 30 is inserted, and a rear connector seating part 155 in which a sub-connector 250 of the sub-blade 200 is seated.

Meanwhile, the blade connector 35 inserted into the rear coupling part 150 may be a separate blade connector 35 formed to be spaced apart from the blade connector 35 inserted into the front coupling part 140.

The rear connector insertion part 151 may be formed as a groove corresponding to the shape of the blade connector 35. For example, the rear connector insertion part 151 may extend in the circumferential direction to draw an arc based on the central axis of the ceiling fan 1 described above.

The rear connector insertion part 151 may be positioned on the same plane as the front connector insertion part 141. Accordingly, even the rear connector insertion part 151 may extend in the circumferential direction along the extension direction of the front connector insertion part 141.

The rear connector insertion part 151 may be formed by recessing the inner surface in which the incision part 110 is formed. For example, the inner circumferential surface of the rear connector insertion part 151 may have the section in the substantial C shape.

When a plurality of main blades 100 are integrally coupled or assembled together, the rear connector insertion part 151 may be coupled to the front connector insertion part 141 of another main blade 100.

In addition, the rear connector insertion part 151 and the front connector insertion part 141, which are connected with each other, may form a groove or a space in which any one blade connector 35 is inserted. Accordingly, the front connector insertion part 141 and the rear connector insertion part 151 may be formed to be positioned at the same height.

The rear connector seating part 155 may be positioned above the rear connector insertion part 151.

The rear connector seating part 155 may be positioned at an upper portion of the rear connector insertion part 151. The rear connector seating part 155 may be formed on the top surface of the rear connector insertion part 151.

The rear connector seating part 155 may extend in the circumferential direction to correspond to the extension direction of the rear connector insertion part 151.

A rear connector hole 156, which is bored downward, may be formed in the rear connector seating part 155. For example, when the housing cover 30, the main blade 100, and the sub-blade 200 are coupled together, the rear connector hole 156 may be positioned to be matched with holes 36 and 37 formed in the blade connector 35 and holes 255 and 256 formed in the sub-connector 250 in the central axis.

In other words, the rear connector hole 156 may be formed at a position vertically aligned with holes formed in the blade connector 35 and the sub-connector 250. Accordingly, at least two holes may be formed in the blade connector 35 and the sub-connector 250 to communicate with the rear connector hole 156 and the front connector hole 146, respectively.

When the plurality of main blades 100 are integrally coupled or assembled together, the front connector seating part 155 is coupled to a rear connector seating part 145 of another main blade 100 to form a surface in which any one sub-connector 250 is seated.

The main blade 100 may have a coupling guide 134 and guide grooves 136 and 137, which are used for guiding the coupling of another main blade 100.

The coupling guide 134 may be formed to protrude from the inner surface of the main blade 100. For example, the coupling guide 134 may be positioned in back of the rear decoration groove 133.

When a plurality of main blades 100 are integrally coupled or assembled together, the coupling guide 134 may be inserted into the guide grooves 136 and 137 of another main blade 100.

The coupling guide 136,137 may be formed to be recessed from the inner surface of the main blade 100. For example, the guide grooves 36 and 137 may be formed such that a top-surface side end and a bottom-surface side end of the front decoration groove 135 are recessed.

The guide grooves 136 and 137 may include an upper guide groove 136 recessed in the top-surface side end and a lower guide groove 137 recessed in the bottom-surface side end.

When a plurality of main blades 100 are integrally coupled or assembled together, the coupling guide 134 of another main blade 100 may be inserted into the guide groove 136. Accordingly, the guide grooves 136 and 137 may be formed in the shape corresponding to the coupling guide 134 formed to protrude. In other words, the guide grooves 136 and 137, and the coupling guide 134 may be formed to be engaged with each other.

Figure 6:
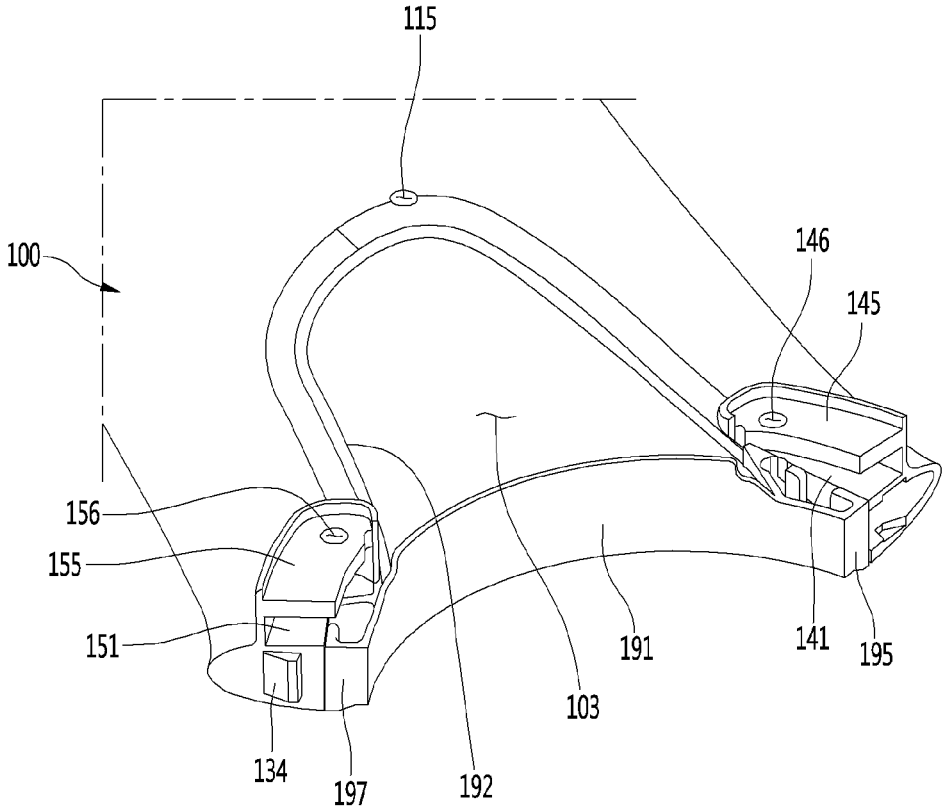
FIG. 6 is an enlarged view that the main blade and the decoration cover are coupled to each other according to an embodiment of the present disclosure.

FIG. 6 is a perspective view that the main blade and the decoration cover are coupled to each other according to an embodiment of the present disclosure.

Referring to FIG. 6, the decoration cover 190 may be inserted into and coupled to the decoration groove 130 of the main blade 100

The front contact part 195 may be inserted into the front decoration groove 135. In addition, the rear contact part 197 may be coupled to the rear decoration groove 133.

The front contact part 195 and the rear contact part 197 may be coupled to the front decoration groove 135 and the rear decoration groove 133 to shield the open space of the front decoration groove 135 and the rear decoration groove 133. In this case, the front snap device 196 and the rear snap device 198 may be fitted into grooves formed corresponding to the front decoration groove 135 and the rear decoration groove 133.

Meanwhile, the decoration cover 190 may be coupled to the main blade 100 in such a manner that the decoration cover 190 is prevented from interfering with the front coupling part 140 and the rear coupling part 150. Accordingly, even if the decoration cover 190 is coupled to the main blade 100, the coupling space between the housing cover 30 and the sub-blade 200 may be maintained, and a user may easily install the housing cover 30 and the sub-blade 200 through the space.

The partition plate 191 may extend from the front contact part 195 and the rear contact part 197 in the concave shape to define a portion of the blade hole 103 and may be spatially separated from the center hole 105.

The blade insertion part 192 may be inserted into the decoration insertion groove 131 to shield a space open inward. In this case, the decoration coupling hole 193 may be positioned to be aligned with the main coupling hole 115.

As the decoration cover 190 is inserted into the main blade 100, the main blade 100 may be implemented to visually provide an aesthetic sense, and a neat outer appearance be obtained.

Figure 7:
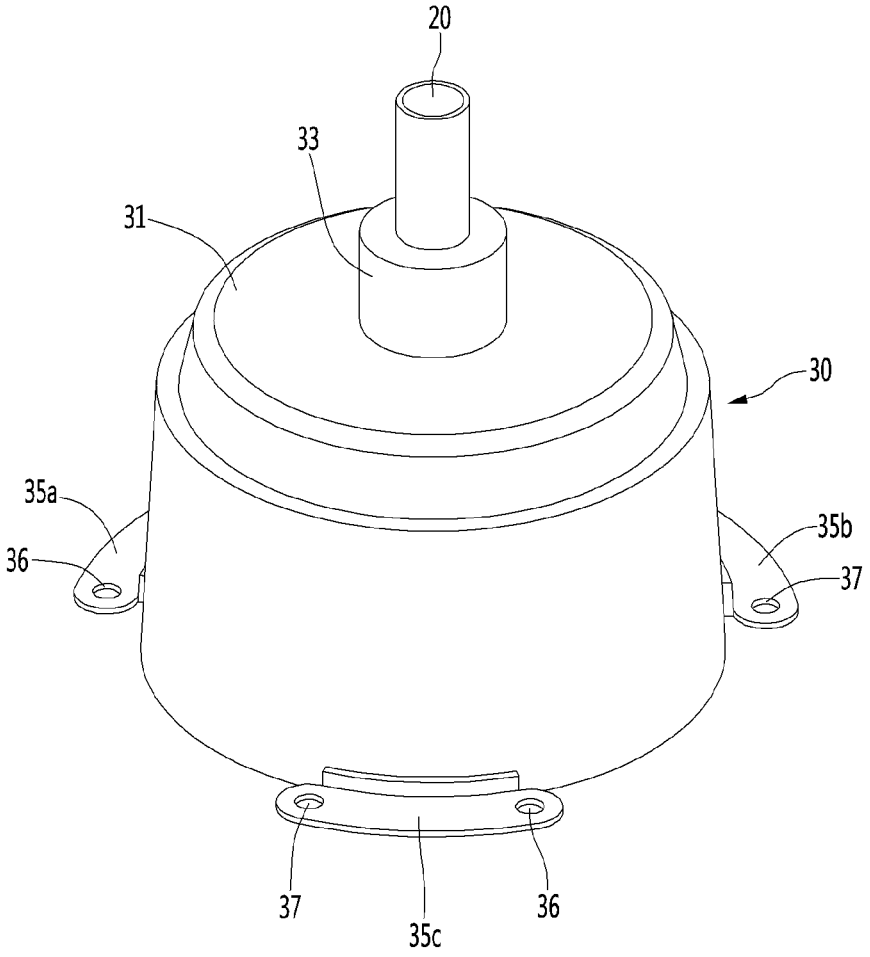
FIG. 7 is a perspective view illustrating a housing cover according to an embodiment of the present disclosure.

FIG. 7 is a perspective view illustrating a housing cover according to an embodiment of the present disclosure, and FIG. is a plan view illustrating that the main blade and the housing cover are coupled to each other according to an embodiment of the present disclosure.

Figure 8:
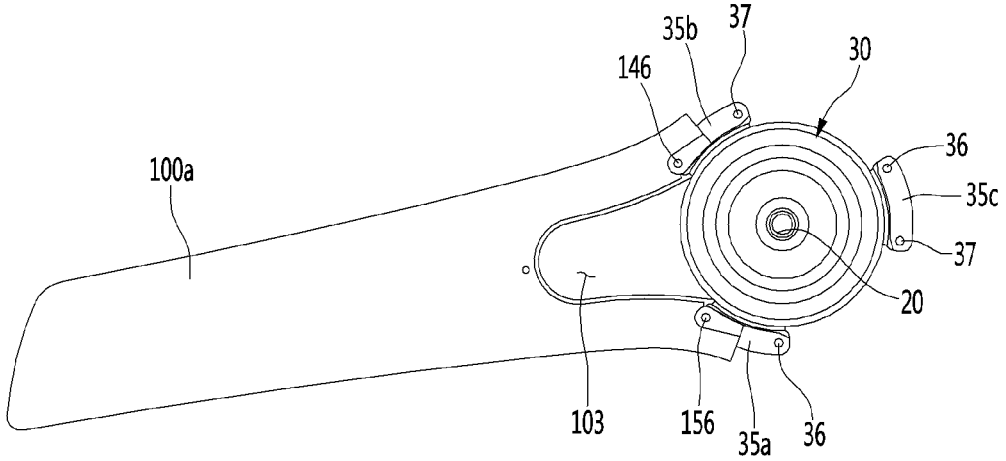
FIG. 8 is a plan view illustrating that the main blade and the housing cover are coupled to each other according to an embodiment of the present disclosure.

Referring to FIGS. 7 and 8, as described above, the housing cover 30 may include the blade connector 35 inserted into the front connector insertion part 141 and the rear connector insertion part 151.

The blade connector 35 may be formed to protrude outward from the outer circumferential surface of the housing cover 30. For example, the blade connector 35 may be formed to extend outward to be perpendicular to the outer circumferential surface of the housing cover 30.

For example, the blade connector 35 may protrude in a radial direction from the lower end of the housing cover 30 and extend such that an arc is formed in the circumferential direction.

In addition, a plurality of blade connectors 35 may be formed. For example, the blade connectors 35 may be formed in number corresponding to the number of the main blades 100.

In detail, the blade connector 35 includes a first blade connector 35*a* coupled with the first main blade 100*a*, a second blade connector 35*b* coupled with the second main blade 100*b*, and a third blade connector 35*c* coupled with the blade 100*c*.

The first to third blade connectors 35*a*, 35*b* and 35*c* may be formed to be spaced apart from each other in the circumferential direction. For example, the first to third blade connectors 35*a*, 35*b*, and 35*c* may be disposed at 120 degrees based on the central axis.

The first to third decoration covers 35*a*, 35*b*, and 35*c* may have the same structure.

The blade connector 35 may guide a plurality of main blades 100 such that the plurality of main blades 100 are connected or coupled. To this end, holes 36 and 37 bored downward may be formed in the blade connector 35.

The holes 36 and 37 may include a rear hole 36 aligned with the front connector hole 146 in the vertical direction and a front hole 37 aligned with the rear connector hole 156 in the vertical direction.

For example, the first blade connector 35*a* may be inserted into the rear connector insertion part 151 of the first main blade 100*a* and the front connector insertion part 141 of the second main blade 100*b* or the third main blade 100*c* subsequently coupled to the rear connector insertion part 151.

In this case, the front hole 37 of the first blade connector 35*a* is connected to communicate with the rear connector hole 156 of the first main blade 100*a*, and the rear hole 36 of the second blade connector 35*b* is connected to communicate with the front connector hole 146 of the first main blade 100*a*.

In other words, the blade connector 35 may be inserted into the front connector insertion part 141 and the rear connector insertion part 151 such that the center of the blade connector 35 is positioned at a coupling point between two main blades 100. Therefore, the blade connector 35 may fix or press the coupling point between the two main blades 100 together with the sub connector 250 in the vertical direction. Meanwhile, the second main blade 100*b* and the third main blade 100*c* may be coupled to the remaining blade connector 35 in the same manner as the first main blade 100*a*.

Figure 9:
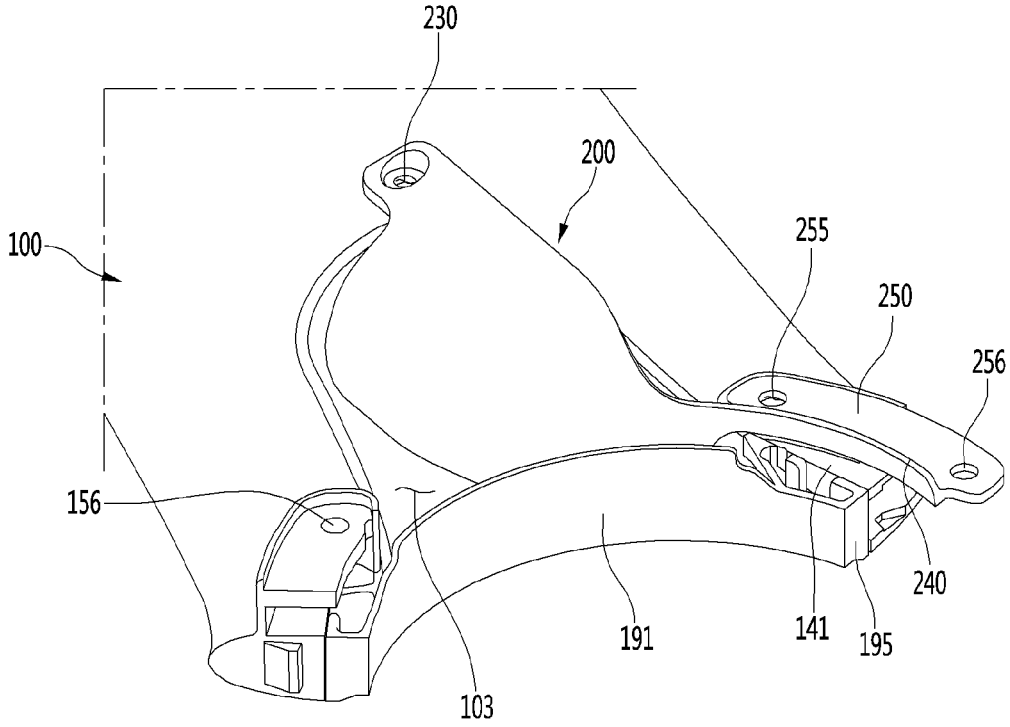
FIG. 9 is an enlarged view that the main blade and the sub-blade are coupled to each other according to an embodiment of the present disclosure.

FIG. 9 is a perspective view that the main blade and the decoration cover are coupled to each other according to an embodiment of the present disclosure.

Referring to FIG. 9, the sub-blade 200 may include a sub-coupling hole 230 formed in one side thereof and a sub-connector 250 formed at an opposite side thereof.

The sub-coupling hole 230 may be seated above the main coupling hole 115 and may be formed to be bored downward.

When the sub-blade 200 is positioned in the blade hole 103, the sub-coupling hole 250 may be positioned to correspond to the main coupling hole 115 in the vertical direction. In other words, the sub-coupling hole 230, the decoration coupling hole 193, and the main coupling hole 115 may be coupled to each other to communicate with each other in the vertical direction.

The sub-connector 250 may be provided to be seated on the front connector seating part 145 and the rear connector seating part 155.

In detail, when the plurality of main blades 100 are coupled, the sub-connector 250 may be seated such that the center of the sub-connector 250 is positioned at the contact point between the front connector seating part 145 of any one main blade and the rear connector seating part 155 provided in another main blade coupled to the main blade.

In other words, the sub-connector 250 may be seated at a position where the two main blades 100 are coupled to each other.

Accordingly, the sub-connector 250 may be formed in a shape corresponding to the shape in which the front connector seating part 145 and the rear connector seating part 155 are connected. For example, the sub-connector 250 may extend in the circumferential direction to correspond to the connector seating parts 145 and 155 in the vertical direction.

The sub-connector 250 may press and fix the coupling portion between the two main blades 100 above and below together with the blade connector 35.

For this purpose, the sub-connector 250 may extend in the same shape as the blade connector 35. For example, the sub-connector 250 may protrude radially from a sub-extension 240 that extends in the circumferential direction to be rounded.

The sub-connector 250 may include a rear corresponding hole 255 and a front corresponding hole 256, which are bored downward.

The rear corresponding holes 255 and the front corresponding holes 256 may be formed to be spaced apart from each other in the circumferential direction.

The rear corresponding hole 255 may be positioned to correspond to the front connector hole 146 and the rear holes 36 in the vertical direction. The front corresponding hole 256 may be positioned to correspond to the front connector hole 156 and the rear holes 37 in the vertical direction.

In other words, when the housing cover 30, the sub-blade 200, and the main blade 100 are coupled or assembled, the rear corresponding hole 255, the front connector hole 146, and the rear hole 36 are engaged to communicate with each other in the vertical direction and may be coupled to each other by a single coupling member.

Similarly, the front corresponding hole 256, the rear connector hole 156, and the front hole 34 may be engaged to communicate with each other in the vertical direction and may be coupled to each other by a single coupling member.

Figure 10:
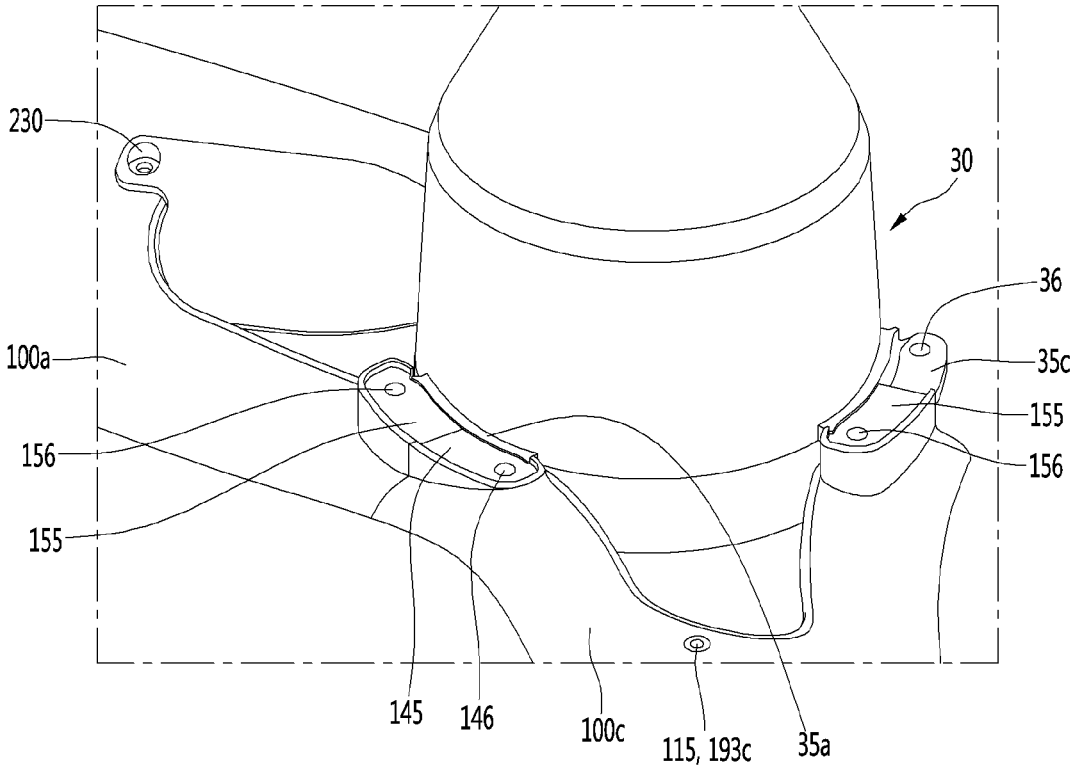
FIG. 10 is an enlarged view that a partial main blade and a partial sub-blade are coupled to the housing cover according to an embodiment of the present disclosure.

FIG. 10 is a perspective view that a partial main blade and a partial sub-blade are coupled to the housing cover according to an embodiment of the present disclosure.

Hereinafter, a method for assembling the ceiling fan 1 according to an embodiment of the present disclosure will be described with reference to FIG. 10.

First, the motor shaft 20 and the electronic unit of the motor assembly may be previously coupled in the internal space of the housing cover 30. In addition, the shaft 10 is installed on the ceiling or the wall surface, and the upper cover 13 and the lower cover 15 may be previously coupled to the outer portion of the shaft 10.

In addition, the user may perform coupling between the main blade 100 and the decoration cover 190. In other words, the decoration cover 190 may be inserted into the decoration groove 130 of the main blade 100.

In this case, the front decoration groove 135 and the front contact part 195 may be engaged with each other and may be coupled to each other by the front snap device 196. In addition, the rear decoration groove 133 and the rear contact part 197 may be engaged with each other and may be coupled to each other by the front snap device 198.

In addition, the blade insertion part 192 is inserted into the decoration insertion groove 131 such that the decoration coupling hole 193 may be positioned under the main coupling hole 115. In this case, the locking protrusion formed in the decoration insertion groove 131 may be inserted into the blade coupling groove 194. Accordingly, the user may couple and stably fix the main blade 100 and the decoration cover 190*a* together without a separate coupling member. The user may couple the first main blade 100*a* and the first decoration cover 190*a*. The second main blade 100*b* and the second decoration cover 190*b* may be coupled to each other and the third main blade 100*b* and the third decoration cover 190*c* may be coupled to each other In this case, the second main blade 100*b* and the third main blade 100*c* may be coupled to the decoration cover 190 after the first main blade 100*a* is mounted on the housing cover 30.

In addition, the user may perform coupling between the main blade 100 and the housing cover 30. In other words, the main blade 100 may be inserted into the blade connector 35 of the housing cover 30.

In detail, the main blade 100 may be mounted on the housing cover 30 in such a manner that any one blade connector 35 is inserted into the front connector insertion part 141, and an adjacent another blade connector 35 is inserted into the rear connector insertion part 151.

In this case, the front connect hole 146 of the main blade 100 is aligned with the rear hole 36 of the any one blade connector 35, and the rear connect hole 156 of the main blade 100 is aligned with the front hole 37 of the another blade connector 35.

For example, the user may insert the rear portion of the second blade connector 35*b* into the front connector insertion part 141 of the first main blade 100*a* and may insert the front portion of the first blade connector 35*a* into the rear connector insertion part 161 of the first main blade 100*a*.

In addition, the user may insert the front portion of the second blade connector 35*b* into the rear connector insertion part 161 of the second main blade 100*b*, and may insert the rear portion of the third blade connector 35*c* into the front connector insertion part 141 of the second main blade 100*b*.

The front portion of the third blade connector 35*c* may inserted into the rear connector insertion part 161 of the third main blade 100*c* and the rear portion of the first blade connector 35*a* may be inserted into the front connector insertion part 141 of the third main blade 100*c*.

Accordingly, the first main blade to the third main blade may be coupled to each other in the circumferential direction to form an integral body.

In addition, the user may perform coupling between the main blade 100 and the housing cover 200.

The sub-blade 200 may be disposed in the blade holes 103 formed in the central portions of the main blades 100 integrally assembled.

The sub-blade 200 may be seated on the top surface of the main blade 100. In detail, the sub-coupling hole 230 is seated on the main coupling hole 115, and the sub-connector 350 is seated on the front connector seating part 145 and the rear connector seating part 155.

In this case, the sub-coupling hole 230, the main coupling hole 115, and the decoration coupling hole 193 are aligned to be connected with each other in the vertical direction.

In addition, the sub-connector 350 may be seated such that the center of the sub-connector 350 is positioned at the coupling point between the front connector seating part 145 of any one main blade and the rear connector seating part 155 provided in another main blade coupled to the main blade.

In this case, the front connector hole 146, the rear hole 36, and the rear corresponding hole 255 are aligned to be connected with each other in the vertical direction. In this case, the rear connector hole 156, the front hole 37, and the front corresponding hole 256 are aligned to be connected with each other in the vertical direction.

Thereafter, the user may firmly couple multiple holes to each other by inserting a coupling member into the multiple holes. In other words, a single coupling member is coupled to the front connector hole 146, the rear hole 36, and the rear corresponding hole 255, and a single coupling member is coupled to the rear connector hole 156, the front hole 37, and the front corresponding hole 256, thereby pressing and stably fixing the coupling point between the two blades at the upper portion and the lower portion.

A single coupling member is coupled to the sub-coupling hole 230, the main coupling hole 115 and the decoration coupling hole 193, thereby stably fixing the sub-blade 200 to the main blade 100.

For example, the first sub-blade 200*a* is positioned in the blade hole 103 formed in the first main blade 100*a*, the second sub-blade 200*b* is positioned in the blade hole 103 formed in the second main blade 100*b*, and the third sub-blade 200*c* is positioned in the blade hole 103 formed in the third main blade 100*c*.

In addition, the sub-connector 250 of the sub-blade may be seated on and coupled to the connector seating parts 145 and 155 and the main coupling hole 155.

Thereafter, the assembling and the installation of the ceiling fan 1 may be completed by coupling the shaft 10 coupled to the ceiling or wall surface to the motor shaft 20.

Meanwhile, according to an embodiment of the present disclosure, the main blade 100 of the ceiling fan 1 is formed in the inner central portion thereof with the blade hole 103. Accordingly, unlike the conventional blade having no blade hole 103, the ceiling fan 1 may have no coupling point formed as the cover is coupled to the inner central portion thereof. Accordingly, the main blade 100 may have coupling points formed at opposite ends spaced apart from each other by the blade hole 103.

However, when coupling points are formed at opposite inner ends of the main blade 100, the number of coupling points is more increased as compared to the conventional blade because there are two coupling points. In this case, vibration, uncoupling, the increase of noise, or coupling stability may be degraded at the coupling points due to the rotation.

Accordingly, in the ceiling fan 1 according to an embodiment of the present disclosure, the blade connector 35 and the sub-connector 250 may press and fix the coupling portion between one main blade 100 and another main blade 100 at the upper and lower portions of the coupling part.

In other words, the coupling portion between a plurality of main blades may be guided such that the housing cover 30 and the sub-blade 200 are fixed to the coupling portion in the vertical direction.

In addition, any one coupling member may be coupled to the sub-connector 250, the main blade 100, and the blade connector 35 by passing through the sub-connector 250, the main blade 100, and the blade connector 35 once.

Accordingly, coupling points positioned at the coupling parts of the main blades 100 may be integrated into one coupling point by the blade connector 35 and the sub-connector 250. Accordingly, the ceiling fan 1 may have coupling points in number equal to the number of coupling points of the conventional blades. In addition, in the ceiling fan 1, a plurality of main blades 100 having blade holes 103 formed in the inner central portion thereof may be more firmly and stably coupled to each other.

In other words, the sub-blade 200, the main blade 100, and the housing cover 30 may be alternately disposed such that the coupling part between two main blades 100 is positioned at the central portions of the sub-connector 250 and the blade connector 35.

In other words, the housing cover 30, the main blade 100, and the sub-blade 200 may be coupled while being chained with each other.

In addition, the blade connector 35 and the sub-connector 250 may enhance the coupling of the main blades 100 above and below, so the coupling force between the plurality of main blades 100 is enhanced. Accordingly, the ceiling fan 1 may stably rotate.

In addition, the bending moment applied to the main blade 100 may be reduced. Therefore, the main blade 100 may be prevented from being warped due to the repeated rotation and the gravity.

Meanwhile, the point in which a plurality of main blades 100 are coupled or assembled together in a circumferential direction may be called a joint part.

In other words, the joint part may be restricted at the upper portion and the lower portion thereof by the housing cover 30 and the sub-blade 200.

Meanwhile, according to the conventional fan, even though the blade is rotated, the air flow red zone, in which the air does not flow, is formed vertically under the ceiling fan.

In detail, the red zone of the air flow may be formed in a local space positioned vertically under the ceiling fan. Since the air flow is significantly weak or stagnant in the red zone of the air flow, the air circulation may be slowly performed. Accordingly, since the whole temperature distribution in the interior space is irregular, the air circulation effect in the room may be deteriorated.

In addition, the air circulation effect is deteriorated around the red zone of the air flow, and even the temperature change is slowly made, so the user around the red zone of the air flow may be difficult to resolve the unpleasant feeling. In other words, the interior position in which the user resolves the unpleasant feeling may be limited.

In addition, since the air volume and the flow rate of the conventional ceiling fan are relatively small, the air-flow reach range is narrow. Accordingly, in the interior space in which the conventional ceiling fan is installed, the air flow is stagnant in not only the red zone of the air flow, but also another local space. Accordingly, the conventional ceiling fan has a limitation in circulating air in a wider interior space.

However, in the ceiling fan 1 according to an embodiment of the present disclosure, dual blades 100 and 200 are rotated to force air to flow. Accordingly, the air volume and the flow rate may be improved. In addition, the red zone of the air flow may be minimized, so the rapid air circulation and uniform indoor temperature may be provided.

In this connection, hereinafter, the dual structure of the blades 100 and 200 included in the ceiling fan 1 according to an embodiment of the present disclosure will be described in detail.

Figure 11:
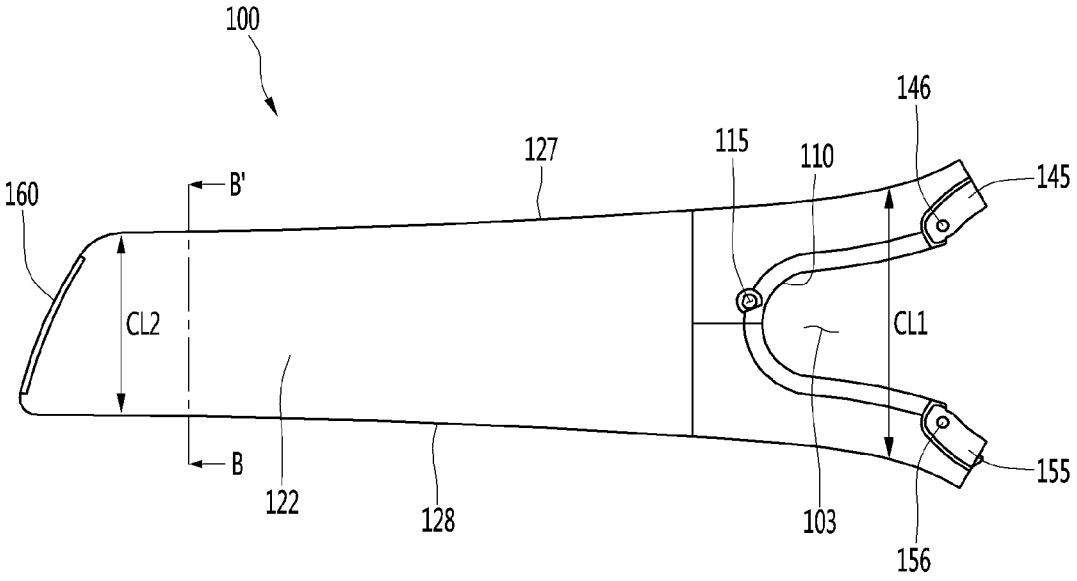
FIG. 11 is a plan view of the main blade according to an embodiment of the present disclosure.

FIG. 11 is a plan view illustrating the main blade according to an embodiment of the present disclosure.

Based on the forward rotation in which the blades 100 and 200 of the ceiling fan 1 rotate in clockwise direction, the direction in which the leading edge 127 of the main blade 100 faces is defined as a forward direction, and the direction in which the trailing edge 128 of the main blade 100 faces is defined as a reward direction.

In other words, the leading edge 127 is positioned at the front end of the main blade 100 and the trailing edge 128 is positioned at the rear end of the main blade 100.

Therefore, at the outer end of the main blade 100, the end of the leading edge 127 may be positioned at the front end, and the end of the trailing edge 128 may be positioned at the rear end. The end of the leading edge 127 may be positioned higher than the end of the trailing edge 128.

The top surface of the main blade 100 is defined as a negative pressure surface 122 and the bottom surface of the main blade 100 is defined as a positive pressure surface 121.

Referring to FIG. 11, the incision part 110 may extend to have a width wider toward the central axis from the center defined as the deepest recessed position in the inner surface of the main blade 100.

The main coupling hole 115 may be formed in the incision part 110. In detail, the main coupling hole 115 may be formed in the upper incision part 110*a*. In addition, the main coupling hole 115 may be formed to be positioned in front of the center of the incision part 110.

Meanwhile, the main blade 100 may extend such that the chord length CL decreases from the inside to the outside.

That is, the main blade 100 may be formed such that the chord length CL decreases toward the radial direction. For example, the chord length CL2 of the inner surface of the main blade 100 may be longer than the chord length CL1 of the outer surface of the main blade 100.

The chord length CL may be defined as a length of a straight line linking the front end that the leading edge 127 is positioned to the rear end that the trailing edge 128 is positioned, when viewed on the longitudinal direction of the main blade 100. Accordingly, the main blade 100 is formed to be slim in the extension direction, so an aesthetic sense is provided.

In addition, the main blade 100 may be formed such that the length of the trailing edge 128 is longer than the length of the leading edge 127. According to another aspect, the main blade 100 may extend such that the length of the rear end o may be longer than the length of the front end.

The outer end of the main blade 100 may be formed in an oblique shape extending in the radial direction rearward.

The main blade 100 may further include a winglet 160 positioned at the end of the negative pressure surface 122.

The winglet 160 may extend upward from an outer end of the negative pressure surface 122. In other words, the winglet 160 may extend in a direction perpendicular to the negative pressure surface 122.

The winglet 160 may prevent a side effect of a vortex, which is generated at an outer end of the negative pressure surface 122, and may reduce vibration and noise.

Figure 12:
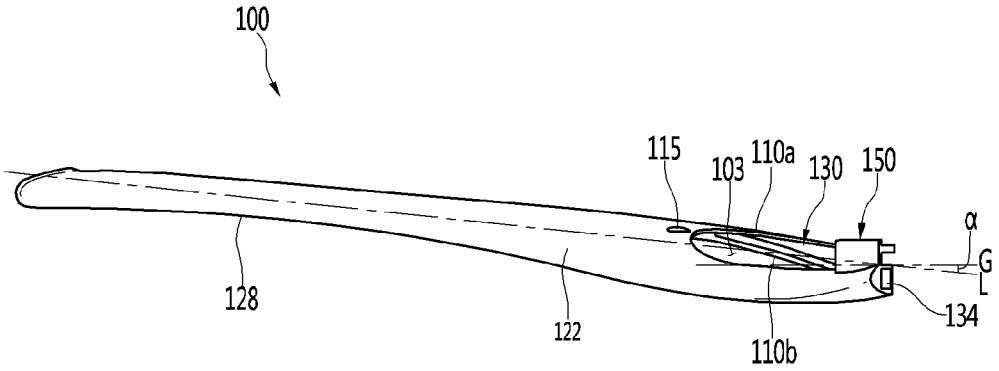
FIG. 12 is a rear view of the main blade according to an embodiment of the present disclosure.
Figure 13:
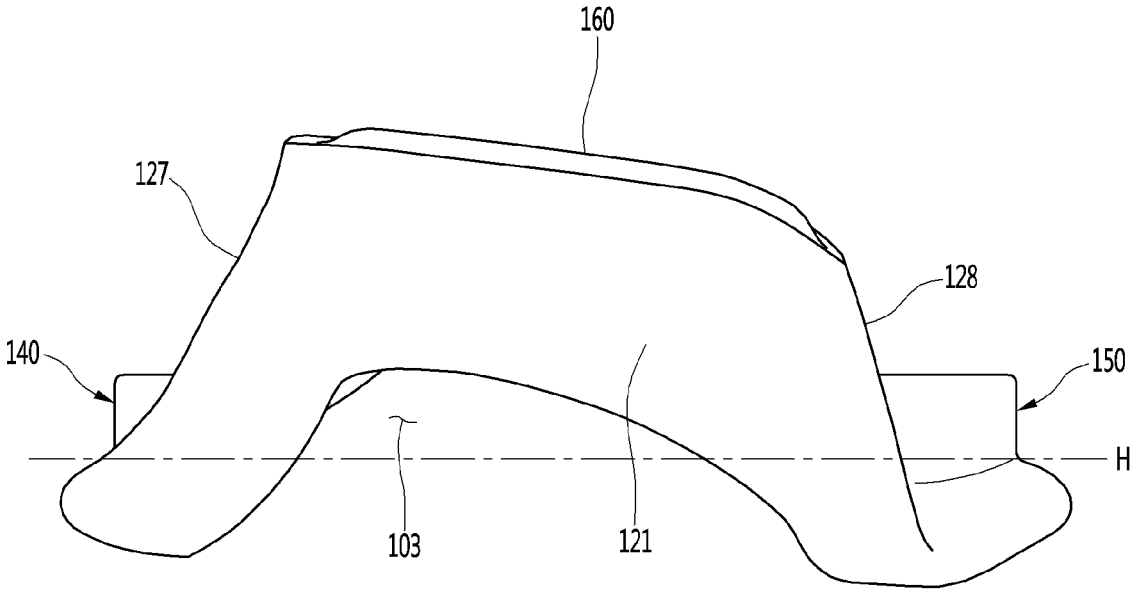
FIG. 13 is a side view of the main blade viewed from the outside according to an embodiment of the present disclosure.

FIG. 12 is an enlarged rear view of the main blade according to an embodiment of the present disclosure. FIG. 13 is a side view of the main blade viewed from the outside according to an embodiment of the present disclosure.

Referring to FIGS. 12 and 13, the main blade 100 may extend to be higher toward the outside. In detail, the main blade 100 may extend so that the positive pressure surface 121 and the negative pressure surface 122 become gradually higher in the radial direction.

The main blade 100 may form the dihedral angle α.

The dihedral angle α may be defined an inclination angle from an inner end (or called "root part") serving as an extension starting point linking the main blade 100 to the housing cover 30 to an outer end (or called "front end")

Referring to FIG. 12, a first horizontal line G corresponding to the horizontal axis of the main blade 100 may be defined. The first horizontal line G may be understood as a virtual straight line located in a direction perpendicular to the second horizontal line H on the same plane.

Further, a wing extension line L, which is a center line drawn along the extension direction of the main blade 100, may be defined.

The dihedral angle α may be defined as an angle formed by the first horizontal line G and the wing extension line L. For example, the above-mentioned dihedral angle α may be set to an acute angle.

The center of gravity of the ceiling fan 1 may be formed higher than the positions of the main blade 100 and the sub-blade 200. As the center of gravity of the ceiling fan 1 is relatively higher than that of the blades 100 and 200, vibrations and noise may be more greatly generated in high-speed rotation.

According to the main blade 100 having the dihedral angle α, the center of gravity of the ceiling fan 1 may be relatively close to the position of the blades 100 and 200. Therefore, vibration and noise are relatively reduced even in high-speed rotation, and stable rotation may be performed.

Figure 14:
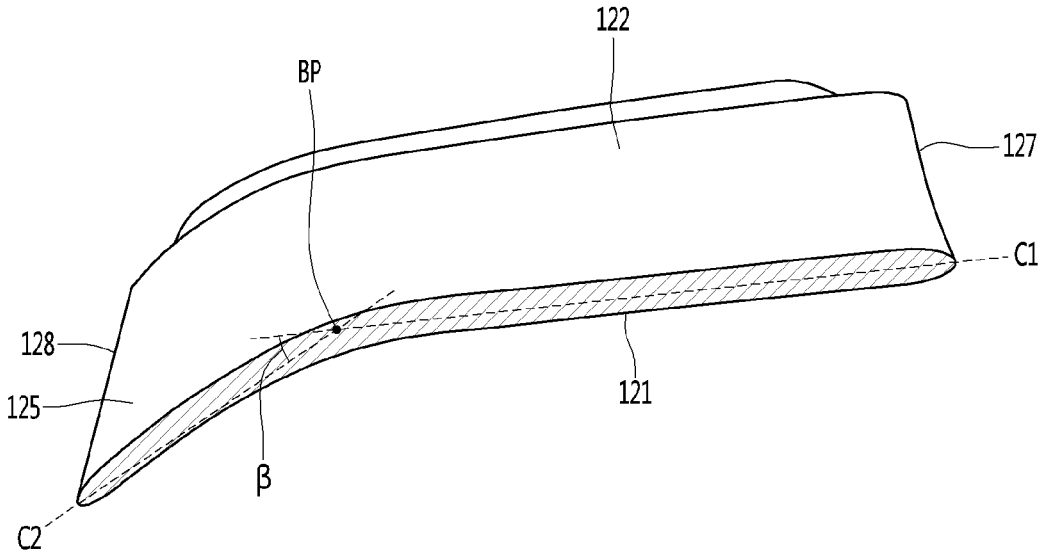
FIG. 14 is a longitudinal sectional view taken along line B-B of FIG. 11.

FIG. 14 is a longitudinal sectional view taken along line B-B of FIG. 11.

Referring to FIG. 14, the main blade 100 may extend to form a curved surface from the leading edge 127 to the trailing edge 128.

The main blade 100 may extend with a predetermined curvature rearward from the front end. In other words, the positive pressure surface 121 and the negative pressure surface 122 may be curved.

In addition, the main blade 100 may extend in such a manner that the extension direction thereof is changed at the bending point BP. In this case, the extension direction may be changed to a second direction, which has a bending angle β to be described, from a first direction which is an extension direction from a front end of the main blade 100.

The bending point BP may be positioned rearward from the intermediate point of the main blade 100.

In addition, the bending point BP may be defined a point at which the first chord line, which is a virtual straight line passing the intermediate point between the negative pressure surface 122 and the positive pressure surface 121 from the leading edge 127, crosses a second chord line C2 which is a virtual straight line passing the intermediate point between the negative pressure surface 122 and the positive pressure surface 121 from the tailing edge 128.

The main blade 100 may have a curved surface bent from the bending point BP.

The angle formed by the first and second chord lines C1 and C2 based on the bending point BP may be defined as a bending angle β. For example, the bending angle β may be set to an acute angle.

The bending angle β may be defined as the slop of a tangential line to the bending point BP of the mean camber line of the main blade 100

The main blade 100 may further include a flap part 125 defined as a part extending backward along the bending angle β from the bending point BP.

The main blade 100 having the flap part 125 has an advantage that a guide area for pushing out the air while rotating is relatively increased. Accordingly, the air volume may be relatively increased. In addition, since the pressure difference between the positive pressure surface 121 and the negative pressure surface 122 is relatively increased, the air circulation ability may be improved.

In summary, when the ceiling fan 1 performs the forward rotation, which is rotation in the clockwise direction, a larger amount of air may be forcibly flown by the main blade 100.

Figure 15:
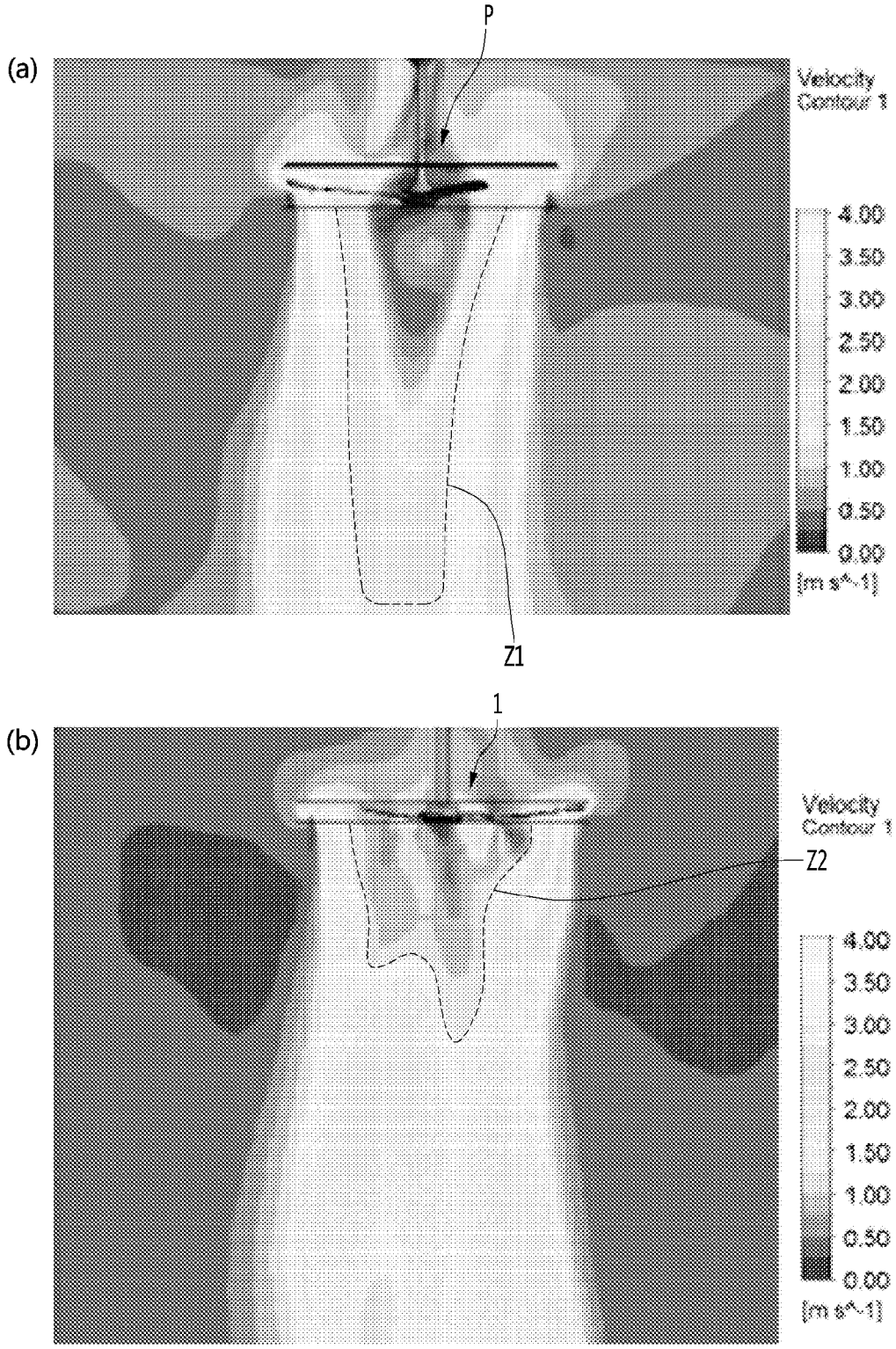
FIG. 15 is sectional view illustrating an experimental graph for comparing in flow velocity distribution of a room between a ceiling fan according to an embodiment of the present disclosure and a conventional ceiling fan.

FIG. 15 is sectional view illustrating an experimental graph for comparing in flow rate distribution of a room between a ceiling fan according to an embodiment of the present disclosure and a conventional ceiling fan.

In detail, FIG. 15A is a view visually illustrating the flow of air, which is made by rotation, based on a velocity distribution when the conventional ceiling fan P is installed in the interior space. FIG. 15B is a view visually illustrating the flow of air, which is made by rotation, based on the velocity distribution, when the ceiling fan 1 according to an embodiment of the present disclosure is installed in the interior space.

Referring to FIG. 15A, in the conventional ceiling fan P having no dual blades according to an embodiment of the present disclosure, it may be recognized that, since the air flow is significantly slow vertically under the ceiling fan P, an air flow red zone Z1, which air circulation become weaker, is widely formed.

In particular, the region right under the conventional ceiling fan P is a region in which the flow rate of the air is almost '0'. Accordingly, when the electronic components are concentrated at a lower end of the ceiling fan P, the heat radiation may be difficult, and a bad influence may be exerted on the air circulation.

Referring to FIG. 15B, when the ceiling fan 1 according to an embodiment of the present disclosure is installed, it may be recognized that the air flow red zone Z2 becomes significantly narrower than the air flow red zone Z1 of the conventional ceiling fan P.

In addition, it may be recognized that the flow rate of air is increased vertically under the ceiling fan 1, when the ceiling fan 1 according to an embodiment of the present disclosure is installed. In other words, it may be recognized that the stagnation of the air flow is minimized.

In this case, the air flow red zone Z1 of FIG. 15A and the air flow red zone Z2 of FIG. 15B are zones in which meaningful air flow is not formed for the sense of comfort of the user, and are marked by a boundary line (dotted line) drawn along equal air flow rates. For example, the boundary line (dotted line) may be drawn based on a flow rate of about 1 m/s or less.

Figure 16:
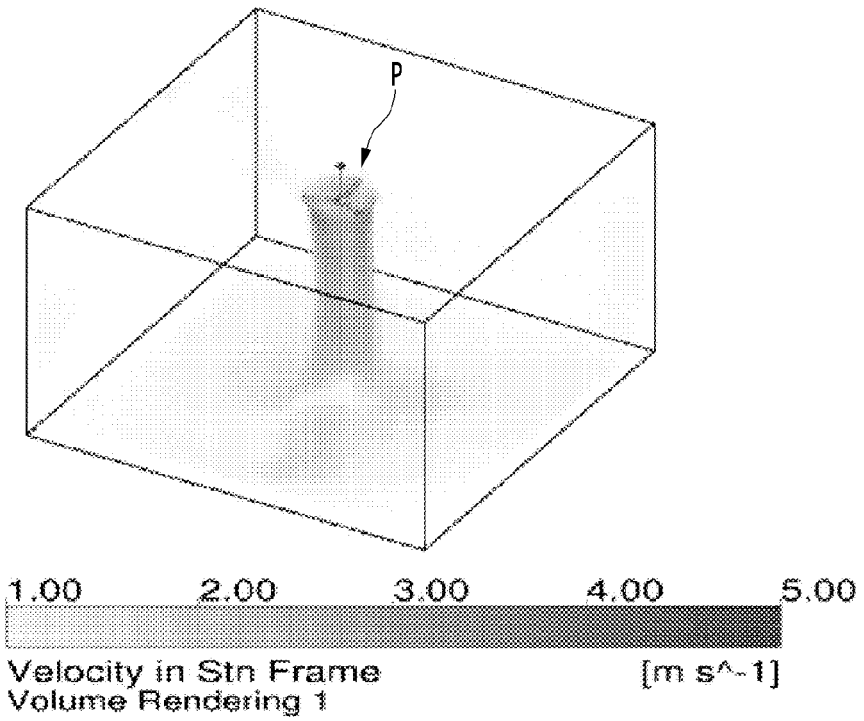
FIG. 16 is a view illustrating an experimental graph for comparing in flow rate distribution between the ceiling fan according to an embodiment of the present disclosure and the conventional ceiling fan in a three-dimensional (3D) manner.
Figure 16:
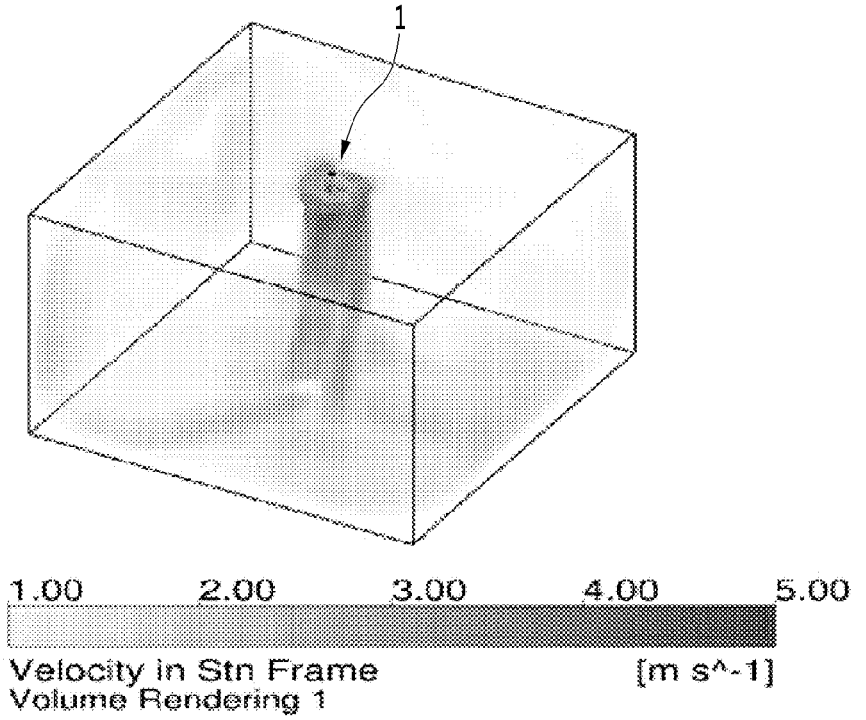

FIG. 16 is a view illustrating an experimental graph for comparing in flow rate distribution between the ceiling fan according to an embodiment of the present disclosure and the conventional ceiling fan in a three-dimensional (3D) manner.

In more detail, FIG. 16A is a view illustrating the flow rate distribution in the 3D manner when the conventional ceiling fan P operates in the interior space, and FIG. 16B is a view illustrating the flow rate distribution in the 3D manner when the ceiling fan 1 according to an embodiment of the present disclosure operates at the same RPM in the same interior space.

Referring to FIGS. 16A and 16B, it may be recognized that the conventional ceiling fan P is lower than the ceiling fan 1 according to an embodiment of the present disclosure in terms of an air volume and a flow rate.

Referring to FIG. 16A, it may be recognized that the conventional ceiling fan P has a narrower air-flow reach range in the interior space. In addition, a larger number of partial spaces, in which the flow rate of air becomes slower and the air flow is stagnant, are formed due to the insufficient air volume and flow rate of the conventional ceiling fan P.

Accordingly, it may be recognized that the air circulation ability is relatively degraded.

To the contrary, referring to FIG. 16B, in the ceiling fan 1 according to an embodiment of the present disclosure, the flow rate and the air volume are relatively increased, so the air-flow reach range is widened. In the interior space in which the ceiling fan 1 is installed, the partial space in which the flow rate of air becomes slower and the air flow is stagnant is disappeared or minimized.

In other words, as compared to the conventional fan P, the ceiling fan 1 may more minimize the local space in which the air flow is stagnant and more improve the air circulation ability as the wind speed rate and the flow rate are increased. Accordingly, as compared to the conventional fan P, the ceiling fan 1 may circulate air in the wider interior space.

Figure 17:
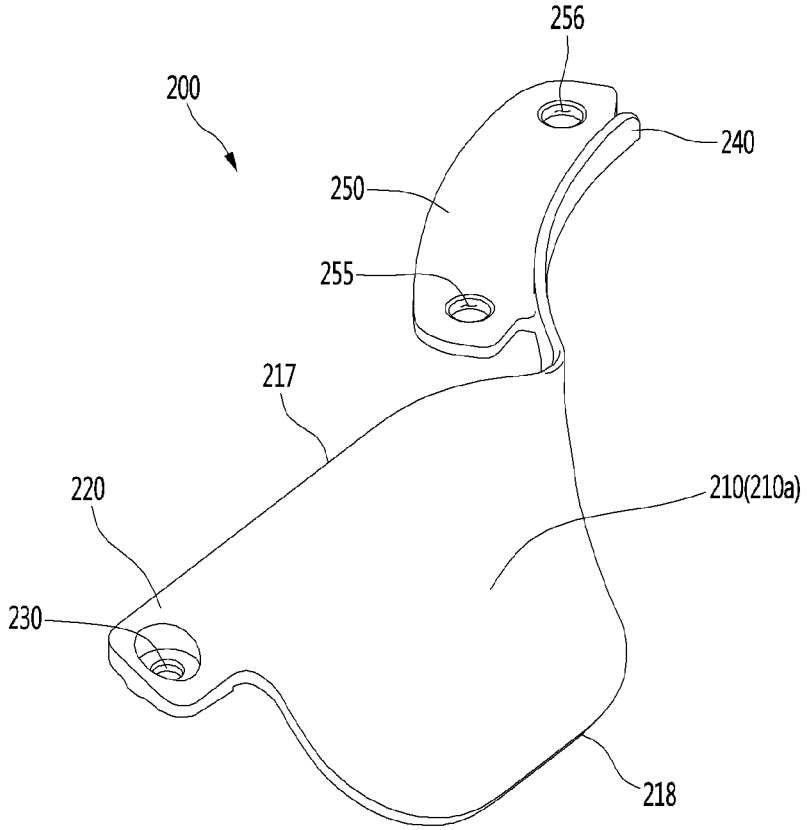
FIG. 17 is a perspective view illustrating a sub-blade according to an embodiment of the present disclosure.

FIG. 17 is a perspective view illustrating a sub-blade according to an embodiment of the present disclosure, and FIG. is a side view illustrating a sub-blade according to an embodiment of the present disclosure.

Figure 18:
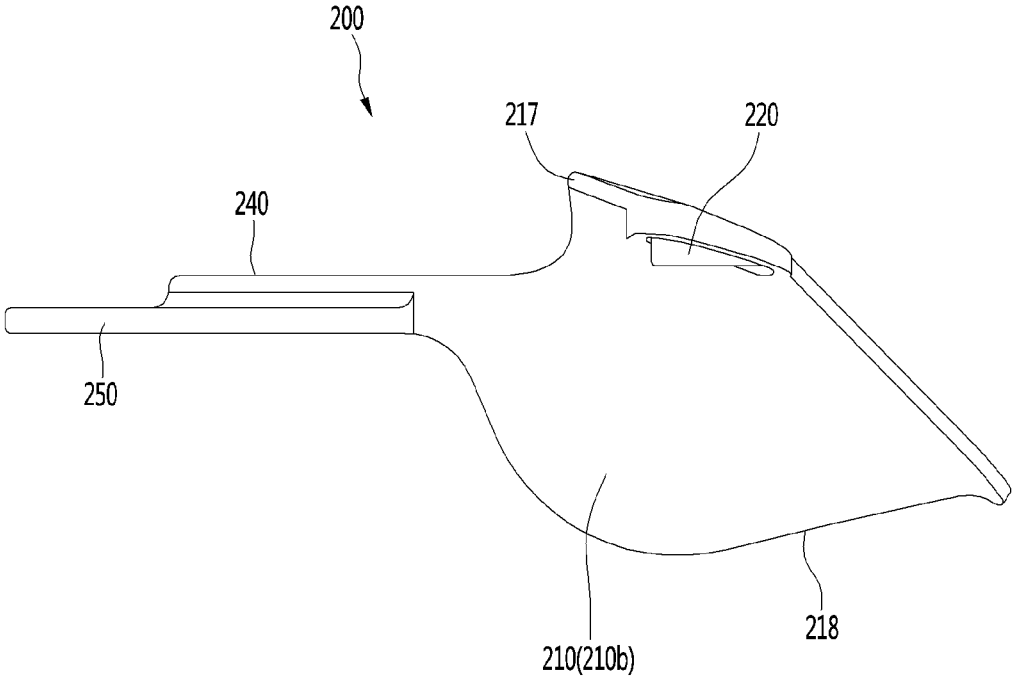
FIG. 18 is a side view illustrating the sub-blade according to an embodiment of the present disclosure.

Referring to FIGS. 17 and 18, the sub-blade 200 may include a blade plate 210 which is an extension surface for guiding air.

Similarly to the main blade 100, the blade plate 210 may have a top surface defined by a negative pressure surface 210*a* and a bottom surface defined by a positive pressure surface 210*b*.

The blade plate 210 may be formed as a curved surface extending upward toward the front portion. The blade plate 210 may extend to have a predetermined curvature.

The front end surface of the blade plate 210 is defined as a leading edge 217 and the rear end surface of the blade plate 210 is defined as a trailing edge 218.

The camber of the blade plate 210 may be formed to be longer than the camber of the main blade 100.

The camber refers to the extent that the mean camber line, which links the intermediate point between the top surface and the bottom surface of the blade when viewed from the sectional surface (air-foil) of the main blade 100 and the sub-blade 200 having curved surfaces, is upward warped. In other words, the camber may be defined as the distance between the mean camber line and the chord line which is the straight line linking the front end and the rear end of the blade.

The sub-blade 200 is disposed to have an angle of attack different from an angle of attack of the main blade 100.

In detail, the front end 217 of the sub-blade 200 may be positioned higher than the incision part 110 of the main blade 100. In detail, the rear end 218 of the sub-blade 200 may be positioned lower than the incision part 110 of the main blade 100.

The front end 217 of the sub-blade 200 is referred to as a sub-leading edge 217 because the front end 210 makes first contact with air in the forward rotation. The rear end 218 of the sub-blade 200 is called a sub-trailing edge 218.

The sub-blade 200 may include a sub-seating part 220 for coupling to the main blade 100.

The sub-seating part 220 may be positioned on one side of the sub-blade 200. In other words, the sub-seating part 220 may be formed to protrude from the upper end of one side of the blade plate 210. For example, the sub-seating part 220 may extend outward from the top surface of the blade plate 210.

The sub-seating part 220 may be seated on the top surface 122 of the main blade 100. For example, the sub-seating part 220 may be seated in the incision part 110 of the main blade 100 in which the main coupling hole 115 is formed.

The sub-seating part 220 may include a sub-coupling hole 230 to which a coupling member may be coupled. In addition, the sub-coupling hole 230 may be aligned above the main coupling hole 115.

In detail, when the sub-blade 200 is seated on the main blade 100, the sub-coupling hole 230 may be positioned corresponding to a main coupling hole 115 in the vertical direction.

Accordingly, a coupling member inserted into the sub-coupling hole 230 may be coupled by passing through both the decoration coupling hole 193 of the decoration cover 190 and the main coupling hole 115.

The sub-blade 200 may further include a sub-extension part 240 a sub-connector 250 to guide the coupling between the plurality of main blades 100.

The sub-seating part 240 may be positioned on an opposite side of the sub-blade 200. The sub-extension part 240 may extend from the opposite end of the blade plate 210 to form a curved line.

The extension direction of the sub-extension part 240 is a direction following the outer circumferential surface of the housing cover 35. The sub-extension part 240 may be formed at the upper end of the blade plate 210.

As described above, the sub-connector 250 may extend forward from the front surface of the sub-extension part 240. The sub-connector 250 may extend to correspond to the inner upper end of the main blades 100, that is, the connector seating parts 145 and 155.

Figure 19:
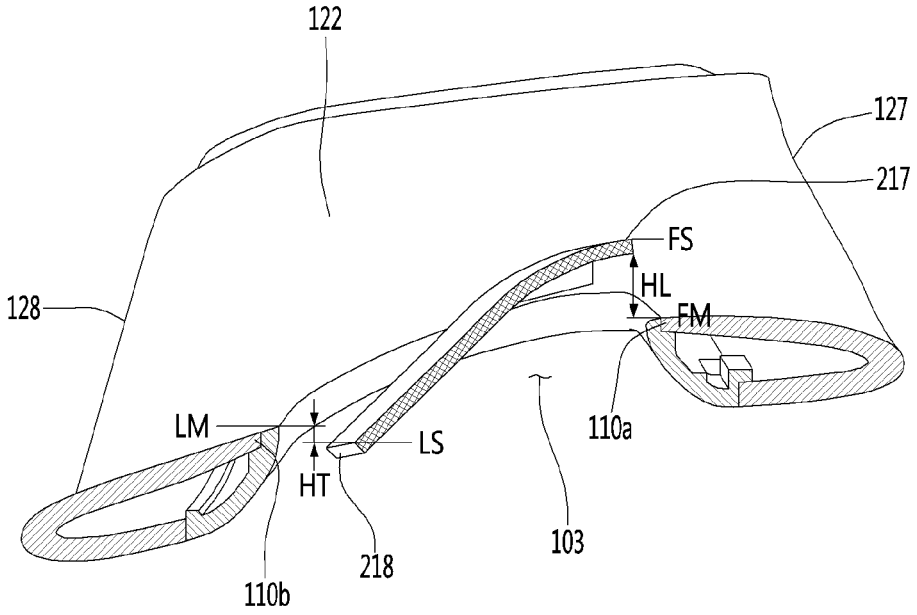
FIG. 19 is a sectional view taken along line A-A of FIG. 1.

FIG. 19 is a cross-sectional view taken along line A-A of FIG. 1.

Referring to FIG. 19, the leading edge 127 of the main blade 100 may be positioned higher than the trailing edge 128 of the main blade 100 in a vertical direction. Therefore, the top surface of the main blade 100 forms a negative pressure surface 122, and the bottom surface of the main blade 100 forms a positive pressure surface 121.

The incision part 110 may extend along the curvature of the main blade 100. The sub-blade 200 may extend with respect to the incision part 110.

The air sucked into a space 103 formed by the incision part 110 is guided downward by the guide of the blade plate 210.

In detail, the sub-blade 200 may be formed such that the sub-leading edge 217 is higher than the incision part 110 and the sub-trailing edge 218 is lower than the incision part 110.

The incision part 110 may include a front incision end 110*a* and a rear incision end 110*b* serving the references of the height of the main blade 100.

The front incision end 110*a* and the rear incision end 110*b* may be positioned on the same vertical plane. The front incision end 110*a* may be defined as an upper end toward the leading edge 127. The front incision end edge 110*a* serves as a reference for determining the distance between the sub-leading edge 217 and the main blade 100.

The rear incision end 110*b* may be defined as an upper end toward the trailing edge 128. The rear incision end edge 110*b* serves as a reference for determining the distance between the sub-trailing edge 218 and the main blade 100.

In this case, a virtual horizontal line passing through the front incision end 110*a* is defined as a front horizontal reference line FM. A virtual horizontal line passing through the rear incision end 110*b* is defined as a rear horizontal reference line LM.

In addition, the virtual horizontal line passing through the front end of the sub-blade 200, that is, one point of the lower edge of the sub-leading edge 217, is defined as a front sub-extension line FS. The virtual horizontal line passing through the rear end of the sub-blade 200, that is, one point of the upper edge of the sub-trailing edge 218, is defined as a rear sub-extension line LS.

The front horizontal reference line FM, the front sub-extension line FS, the rear horizontal reference line LM, and the rear sub-extension line LS may be parallel to each other and may be located on the same vertical plane.

As described above, the sub-leading edge 217 may be positioned higher than the incision part 110. In addition, the sub-trailing edge 218 may be positioned lower than the incision part 110.

In other words, since the sub-leading edge 217 is positioned higher than the incision part 110, air may be forced to flow into the blade hole 103. Therefore, the suction flow rate may be increased relatively more than the conventional blade having no the sub-blade 200.

Since the sub-trailing edge 218 is positioned lower than the incision part 110, the air introduced into the blade hole 103 is flow down in more amount by the guide of the blade plate 210*b*.

Therefore, the ceiling fan 1 forms a central air flow passage by the blade holes 103 formed in the main blade 100 and the sub-blades 200, thereby relatively increasing the flow rate of surrounding air of the housing cover 35 as compared to that of the conventional ceiling fan. Accordingly, the air volume may be improved and the fan efficiency may be improved.

Figure 20:
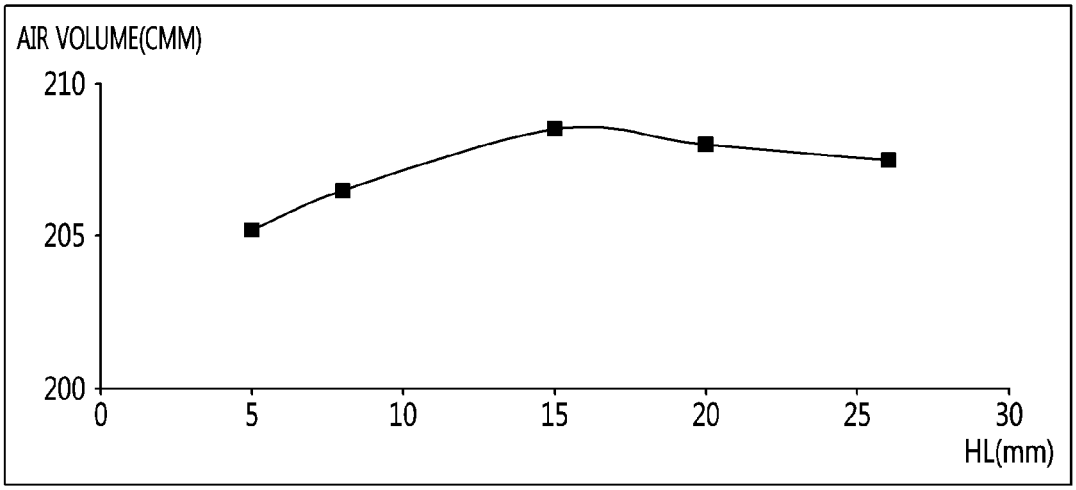
FIG. 20 is an experimental graph illustrating air volume values depending on the variation of a height of a sub-blade according to an embodiment of the present disclosure.
Figure 20:
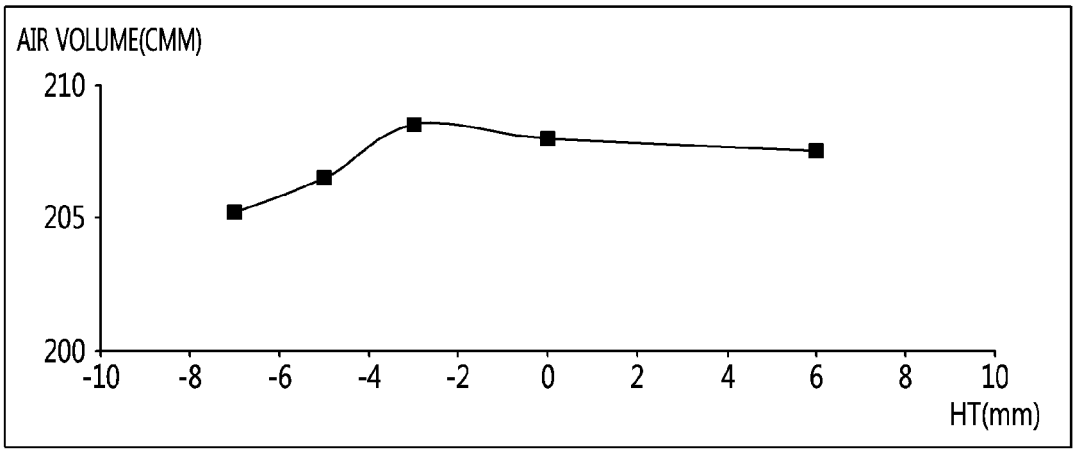

FIG. 20 is an experimental graph illustrating air volume values depending on the variation of a height of a sub-blade according to an embodiment of the present disclosure.

FIG. 20A is an experimental graph illustrating the air volume as a function of the distance HL between the front horizontal reference line FM and the front sub-extension line FS. FIG. 20B is an experimental graph illustrating the air volume as a function of the distance HT between the rear horizontal reference line LM and the rear sub-extension line LS.

The distance HL between the front horizontal reference line FM and the front sub-extension line FS means the difference in height between the sub-leading edge 217 and the incision part 110. Therefore, the distance between the front horizontal reference line FM and the front sub-extension line FS is referred to as a first distance HL.

The distance HT between the rear horizontal reference line LM and the rear sub-extension line LS means the difference in height between the sub-trailing edge 218 and the incision part 110. Therefore, a distance between the rear horizontal reference line LM and the rear sub-extension line LS is referred to as a second distance HT.

Here, a positive (+) sign is used for a position higher than the incision ends 110*a* and 110*b* and a negative (−) sign is used for a position lower than the incision ends 110*a* and 110*b*, based on the incision ends 110*a* and 110*b* of the main blade 100.

Referring to FIGS. 20A and 20B, when the first distance HL is +5 mm and the second distance HT is −7 mm, the air volume CMM of the ceiling fan 1 is set to a reference (0%).

In detail, when the first distance HL is +8 mm and the second distance HT is −5 mm, the air volume is increased by 0.7% from the reference.

In addition, when the first distance HL is +15 mm and the second distance HT is −3 mm, the air volume is increased by 2% from the reference.

In addition, when the first distance HL is +20 mm and the second distance HT is 0 mm, the air volume is increased by 1.5% from the reference.

In addition, when the first distance HL is +25 mm and the second distance HT is 6 mm, the air volume is increased by 1.2% from the reference.

In other words, the ceiling fan 1 may provide the maximum air volume when the first distance HL is 15 mm and the second distance HT is −3 mm.

Figure 21:
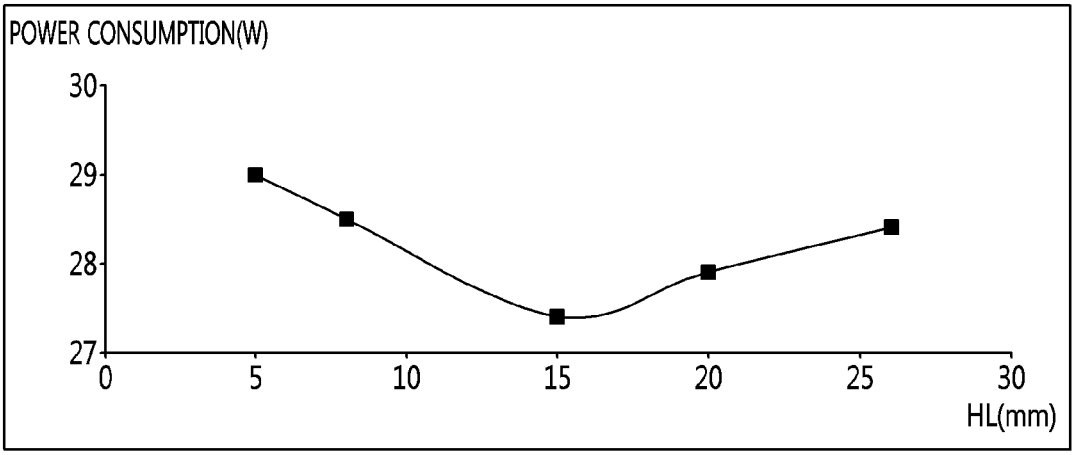
FIG. 21 is an experimental graph illustrating power consumption values depending on the variation of a height of a sub-blade according to an embodiment of the present disclosure.
Figure 21:
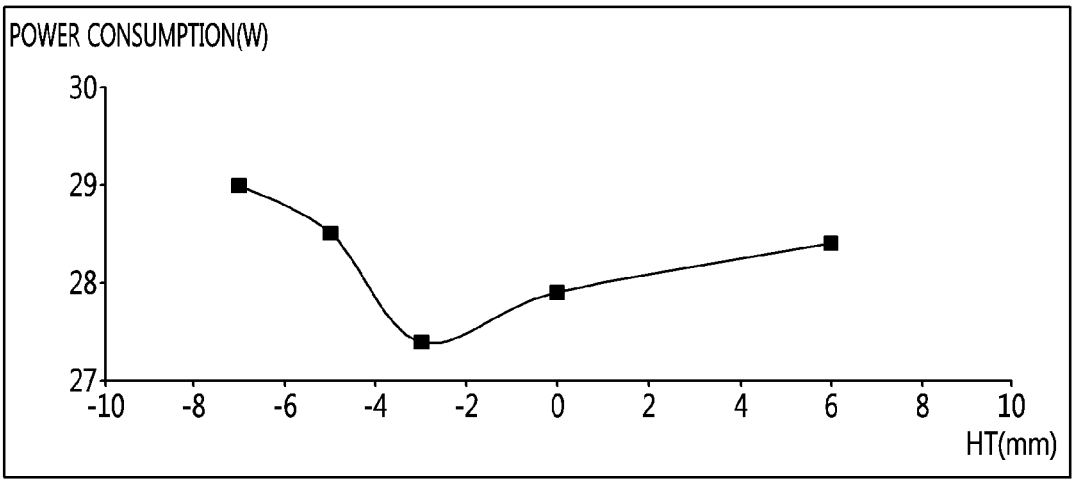

FIG. 21 is an experimental graph illustrating power consumption depending on the variation of a height of a sub-blade according to an embodiment of the present disclosure.

FIG. 21A is an experimental graph illustrating the power consumption as a function of the distance HL between the front horizontal reference line FM and the front sub-extension line FS. FIG. 21B is an experimental graph illustrating the power consumption as a function of the distance HT between the rear horizontal reference line LM and the rear sub-extension line LS.

Referring to FIGS. 20A and 20B, when the first distance HL is +5 mm and the second distance HT is −7 mm, the power consumption W of the ceiling fan 1 is set to a reference (0%). In detail, when the first distance HL is +8 mm and the second distance HT is −5 mm, the power consumption is decreased by 1.7% from the reference.

In addition, when the first distance HL is +15 mm and the second distance HT is −3 mm, the power consumption is decreased by 4.5% from the reference.

In addition, when the first distance HL is +20 mm and the second distance HT is 0 mm, the power consumption is decreased by 3.8% from the reference.

In addition, when the first distance HL is +25 mm and the second distance HT is 6 mm, the power consumption is decreased by 2.1% from the reference.

In other words, when the first distance HL is 15 mm and the second distance HT is −3 mm, the ceiling fan 1 may provide the largest air volume while using the smallest power consumption.

In summary, the sub-blade 200 may be formed such that the sub-leading edge 217 is spaced from the incision part 110 by a first distance HL. The first distance HL may have a value of 0 mm or more and 26 mm or less.

Preferably, the first distance HL may have a value of 13 mm or more and 18 mm or less. In other words, the sub-leading edge 217 may be positioned 13 to 18 mm higher than the incision part 110.

In addition, the sub-blade 200 may be formed such that the sub-trailing edge 218 is spaced apart from the incision part 110 by a second distance HT. The second distance HL may have a value of −10 mm or more and 10 mm or less. Preferably, the second distance HL may have a value of −4 mm or more and −1 mm or less. In other words, the sub-trailing edge 218 may be positioned 1 mm to 4 mm lower than the incision part 100. Accordingly, the sub-blade 200 may provide the optimal air volume while using the minimum power consumption.

Figure 22:
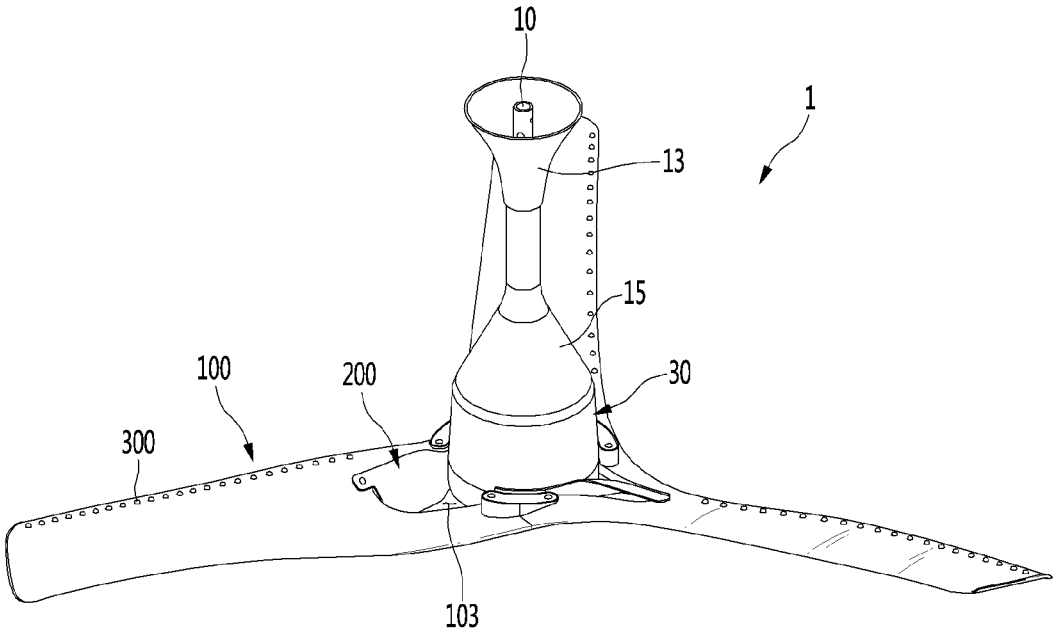
FIG. 22 is a perspective view illustrating the ceiling fan according to a second embodiment of the present disclosure.

FIG. 22 is a perspective view illustrating a ceiling fan according to a second embodiment of the present disclosure.

The description of the components, which are the same as above-described components, of components in a second embodiment of the present disclosure, will employ the description of the previous embodiment of the present disclosure.

Meanwhile, flow separation may occur (see T in FIG. 25) on the negative pressure surface of the main blade 100. In this case, the flow separation refers to a phenomenon in which air (fluid) particles attached to the surface of the blade are separated as the adverse pressure gradient, in which the pressure increases along the flow direction of the air (fluid), is increased.

The flow separation may cause the noise of the fan to increase. In addition, as the rotation speed of the fan is increased to produce larger air volume, the flow separation may increase.

Referring to FIG. 22, the ceiling fan 1 according to the embodiment of the present disclosure may include a plurality of protrusions 300 to prevent the flow separation. The plurality of protrusions 300 may be formed on the main blade 100.

The plurality of protrusions 300 may be formed on the negative pressure surface 122. The plurality of protrusions 300 may be positioned along the extension direction of the leading edge 127.

A virtual line connecting the upper ends of the plurality of protrusions 300 may form the same curvature as an virtual line drawn along the extension direction of the main blade 100.

At the negative pressure surface 122, air may flow from the leading edge 127 to the trailing edge 128. The plurality of protrusions 300 may be formed at a position adjacent to the leading edge 127 on the negative pressure surface 122.

The plurality of protrusions 300 may be spaced apart from each other in the radial direction. The plurality of protrusions 300 may protrude upward from the negative pressure surface 122.

For example, the protrusions 300 may be formed in a cylindrical shape extending upward. The upper end of the protrusion 300 may have a rounded hemispherical shape.

The plurality of protrusions 300 may generate turbulence in the air flowing along the negative pressure surface 122. If the turbulence is generated, the flow separation is prevented or minimized. Therefore, the noise of the ceiling fan 1 may be minimized.

Figure 23:
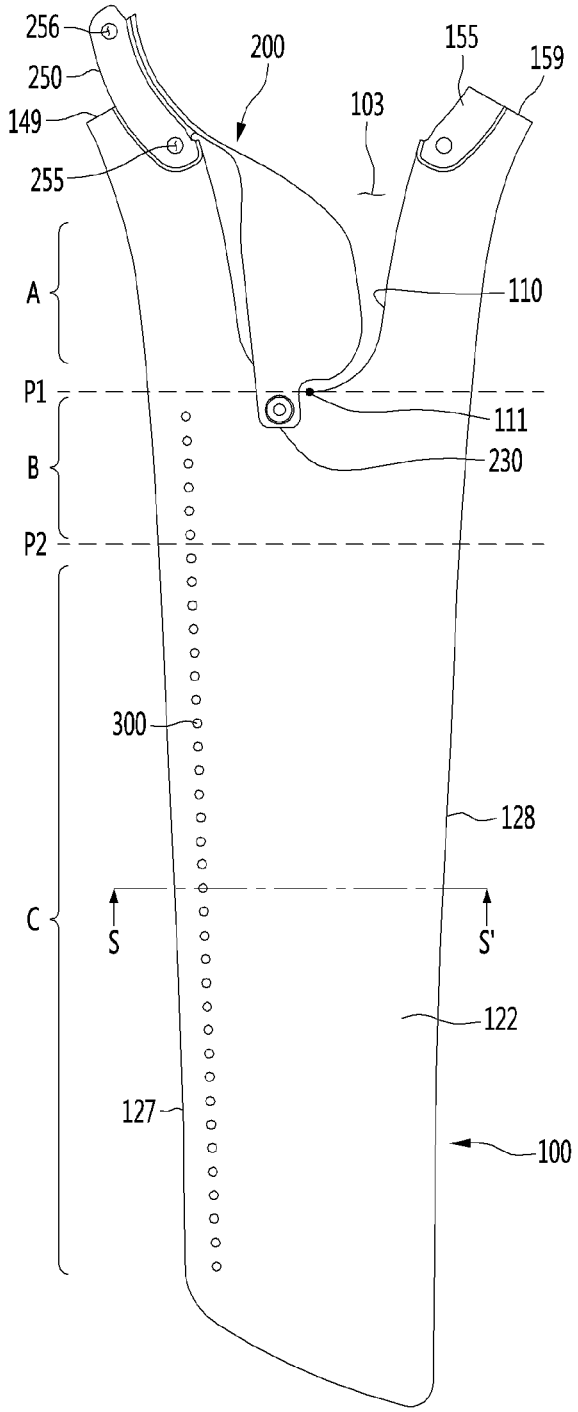
FIG. 23 is a plan view of the main blade according to an embodiment of the present disclosure.
Figure 24:
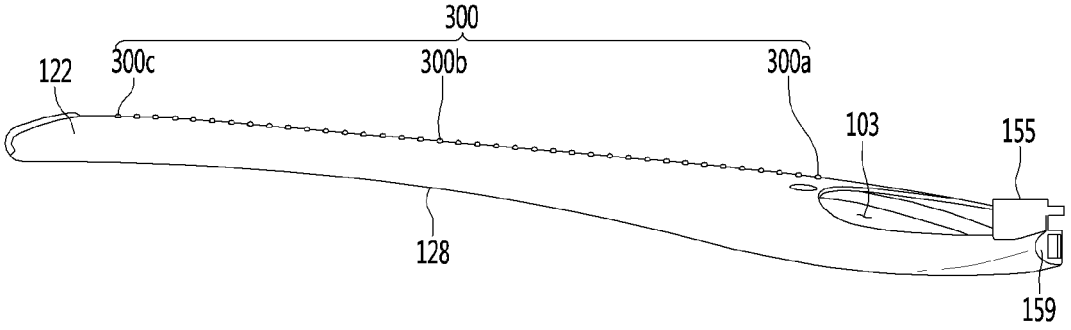
FIG. 24 is a rear view of the main blade according to an embodiment of the present disclosure.

FIG. 23 is a plan view of the main blade according to the second embodiment of the present disclosure, and FIG. 24 is a rear view of the main blade according to the second embodiment of the present disclosure.

Referring to FIGS. 23 and 24, a virtual straight line bisecting the incision part 110 or the blade hole 103 in the forward and backward directions may pass through the bisector 111 of the incision part 110.

In this case, the bisector 111, which is the outer most point in the incision part 110, may be defined as the outer most position. In this case, the bisector 111 may be defined as the outer most position of the blade hole 103.

Meanwhile, the main blade 100 may be divided into three parts.

In detail, the main blade 100 may include a blade fixing part A which is a part extending to a first dividing line H1, which is defined as a tangential line of the bisector 111, in a radial direction from the inner front end 149 and the inner rear end 159.

The blade fixing part A may be understood as an area of the main blade 100 allowing the air in contact with the leading edge 127 to flow to the blade hole 103 and the sub-blade 200.

The main blade 100 may further include a blade assembling part B extending by a predetermined distance in a radial direction from the blade fixing part A.

The blade assembling part B may be understood as an area of allowing the air in contact with the leading edge 127 to flow along the negative pressure surface 122, and of reducing the influence of air flow caused by the blade hole 103 and the sub-blade 200 in the radial direction.

The blade assembling part B may be understood as a part extending from the first dividing line P1 to a second dividing line P2 which is a virtual straight line parallel to the first dividing line P1. For example, the blade assembling part B may be a part formed by combining a portion of the main blade 100 extending from the inner front end 149 with a portion of the main blade 100 extending from the rear front end 159.

The second dividing line P2 may also be defined as an extension start position of a blade extension part C. In addition, the second dividing line P2 may be understood as a line from which air in contact with the leading edge 127 is out of the influence of the sub-blade 200 and totally flows along the negative pressure surface 122.

The main blade 100 may further include the blade extension part C extending from the blade assembling part B to an outer end of the negative pressure surface 122.

The blade extension part C may be understood as an area in which the air is in contact with the leading edge 127 flows along the negative pressure surface 122 without change.

The plurality of protrusions 300 may be formed on the blade assembling part B and the blade extension part C, respectively.

In detail, the blade fixing part A is a part allowing the air, which is contact with the leading edge 127 to pass through the front end of the negative pressure surface 122 and to forcibly flow into the blade hole 103 by the sub-blade 200.

In other words, in the blade fixing part A, the width of the negative pressure surface 122, through which the air in contact with leading edge 127 passes, is very narrow, and the air flows to be forced by the blade hole 103 and the sub-blade 200. Accordingly, the blade fixing part A is an area in which the turbulence is significantly slightly generated by the protrusion 300. In other words, the blade fixing part A may be understood as an area having no effect of preventing the flow separation by generating the turbulence of the above-described negative pressure surface 122.

Accordingly, the plurality of protrusions 300 may not be formed on the negative pressure surface 122 corresponding to the blade fixing part A.

In other words, the plurality of protrusions 300 may be formed in the radial direction from the position of the negative pressure surface 122, which corresponds to the outer most position of the incision part 110. For example, the plurality of protrusions 300 may be formed in the extension direction of the main blade 100 from the first dividing line P1 passing the bisector 111.

The plurality of protrusions 300 may be spaced apart from each other by distances preset in the radial direction. In addition, the distances preset in the radial direction may have identical to each other, but the present disclosure is not limited thereto.

Meanwhile, in the blade assembling part B, the plurality of protrusions 300 may be formed such that the distance from the leading edge 127 is reduced in the radial direction.

In addition, in the blade extension part C, the plurality of protrusions 300 may be formed such that the distance from the leading edge 127 is equal in the radial direction.

Accordingly, when the forward rotation of the ceiling fan 1 is performed, the air in contact with the leading edge 127 may generate the turbulence suitably for the flowing environment of the blade assembling part B and the blade extension part C while passing through the plurality of airs 300.

The turbulence generated by the plurality of protrusions 300 may prevent flow separation of the air flowing toward the trailing edge 127.

Figure 25:
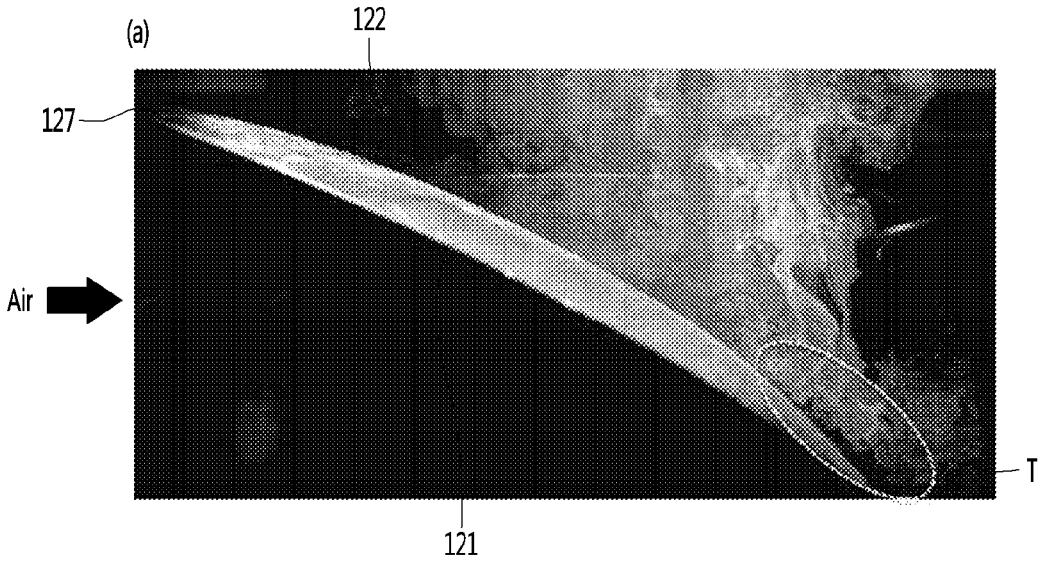
FIG. 25 is a view illustrating the comparison in air flow between when there is present a protrusion or when there is absent the protrusion according to the second embodiment of the present disclosure.
Figure 25:
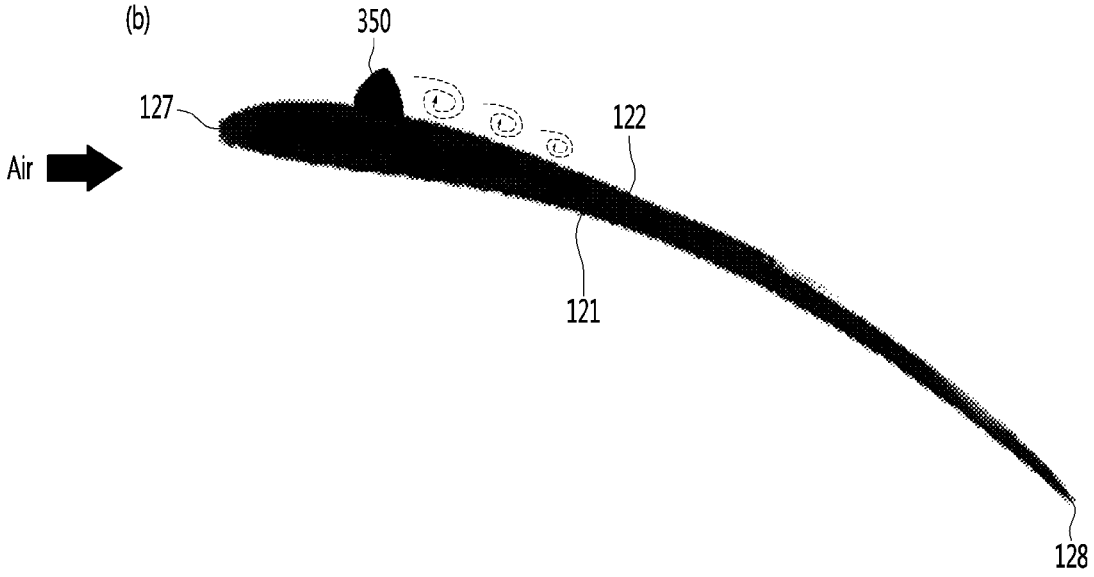

FIG. 25 is a view illustrating the comparison in air flow between when there is present a protrusion or when there is absent the protrusion according to the second embodiment of the present disclosure. In detail, FIG. 25A is a view illustrating the experiment of showing air flow on the negative pressure surface of the blade having no above-described protrusions 300 and FIG. 25B is a view illustrating the air flow on the negative pressure surface 122 of the main blade 100 having the above-described protrusions 300.

Referring to FIG. 25A, it may be identified that the air in contact with the leading edge 127 is subject to the flow separation T while flowing along the negative pressure surface 122.

When the flow separation is caused, the pressure is varied to cause noise. In addition, the flow separation may be greatly caused as the air volume is increased.

FIG. 25B is a sectional view taken along line S-S' of FIG. 23.

Referring to FIG. 25B, the protrusions 300 formed to be adjacent to the leading edge 127 may generate the turbulence on the negative pressure surface 122.

In detail, the air flowing along the negative pressure surface 122 makes contact with the protrusions 300, and the air passing through the protrusions 300 may generate the turbulence in back of the protrusions 300.

Since the vortex is generated at the pattern point along the negative pressure surface 122, the air particles can generate turbulence that is irregular and curved.

The turbulence generated by the protrusions 300 may be generated in the front portion of the negative pressure surface 122 relatively to affect the flow of air flowing toward the trailing edge 128. Accordingly, the above-described phenomenon of increasing the adverse pressure gradient may be prevented. Accordingly, the flow separation phenomenon occurring at a position close to the trailing edge 128 of the existing negative pressure surface 122 may be prevented.

Figure 26:
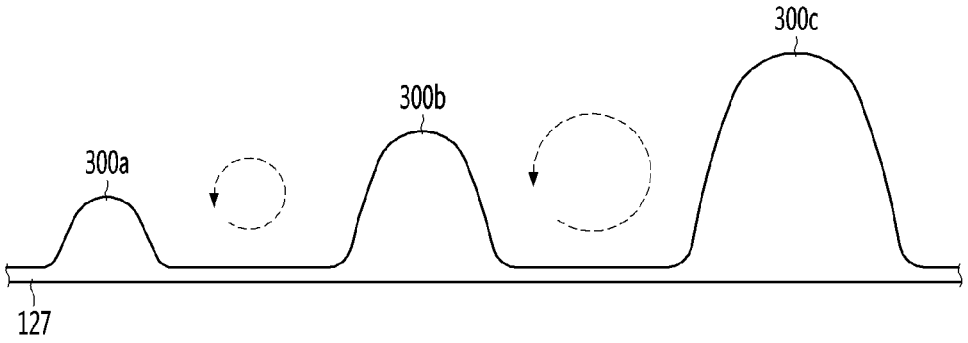
FIG. 26 is a view illustrating a shape of a protrusion according to the second embodiment of the present disclosure.

FIG. 26 is a view illustrating a shape of a protrusion according to the second embodiment of the present disclosure.

Referring to FIG. 26, a plurality of protrusions 300 may be formed in different sizes toward the radial direction.

In detail, the plurality of protrusions 300 may be formed to be larger toward the outer side in the direction of the end of the main blade 100. For example, the plurality of the protrusions 300 may be formed to have the heights increased in the radial direction.

The plurality of protrusions 300 may include a first protrusion 300*a* formed at a position closest to the incision part 110, a second protrusion 300*a* positioned to be spaced apart from the first protrusion 300*a* in the radial direction, and a third projection 300*c* positioned to be spaced apart from the second protrusion 300*b* in the radial direction.

As the ceiling fan 1 rotates, since the radius increases from the center of the ceiling fan 1 toward the third projection 300*c* from the first projection 300*a*, the linear velocity at the three protrusions 300*c* is larger than the linear velocity at the second and first protrusions 300*a* and 300*b*.

Accordingly, the air flow may be appropriately controlled by making the size of the third protrusion 300*c* larger than the size of the second protrusion 300*b*.

Similarly, the size of the second protrusion 300*b* may be smaller than that of the third protrusion 300*c* and larger than that of the first protrusion 300*a*.

When the air flowing along the negative pressure surface 122 passes between the first protrusion 300*a* and the second protrusion 300*b*, the air meeting the second protrusion 300*b* may have energy greater than that of the air meeting the first protrusion 300*a* because the second protrusion 300*b* is larger than the first protrusion 300*a*.

Accordingly, the air moving along the side of the second protrusion 300*b* may move at a speed faster than a speed of the air moving along the side of the first protrusion 300*a*. Accordingly, the vortex (dotted line) may be formed between the first protrusion 300*a* and the second protrusion 300*b*. Similarly, the vortex (dotted line) may be formed between the second protrusion 300*b* and the third protrusion 300*c*.

The turbulence, in which the air flow is irregular, is more strongly formed at the front portion of the negative pressure surface 122 due to the vortex generated between protrusions 300*a*. Accordingly, the flow separation at the rear end of the negative pressure surface 340 may be minimized.

The invention claimed is:

1. A ceiling fan comprising:

a shaft to couple to a wall surface;

a cover to surround the shaft;

a main blade to couple to the cover to allow air to forcibly flow through rotation, the main blade including an opening; and a sub-blade to position in the opening formed in the main blade, wherein the sub-blade is disposed to have an angle of attack different from an angle of attack of the main blade.

2. The ceiling fan of claim 1, wherein the main blade includes a blade hole defined as the opening and having a form of being recessed from an inner surface of the main blade, and wherein the sub-blade is seated in the main blade such that the sub-blade is positioned in the blade hole.

3. The ceiling fan of claim 1, wherein the main blade includes a curved surface from a front end to a rear end.

4. The ceiling fan of claim 1, wherein the cover includes:

an upper cover to make contact with the ceiling;

a lower cover coupled to a lower portion of the upper cover; and a housing cover positioned under the lower cover, wherein the housing cover couples with the main blade.

5. The ceiling fan of claim 1, wherein the main blade includes:

a plurality of protrusions protruding from a negative pressure surface of the main blade.

6. The ceiling fan of claim 5, wherein the plurality of protrusions are arranged in an outward direction of the main blade adjacent to a leading edge of the main blade while being spaced apart from each other by a predetermined distance.

7. The ceiling fan of claim 5, wherein the main blade further includes:

an incision part to form a central space and to define the opening having a form of being recessed from an inner surface of the main blade;

a blade fixing part defining a main blade part that includes the incision part up to an outermost position of the incision part;

a blade assembling part extending from the blade fixing part by a predetermined length; and a blade extension part extending from the blade assembling part to an outer end of the main blade, wherein the plurality of protrusions are formed on the blade assembling part and the blade extension part.

8. The ceiling fan of claim 1, wherein the main blade includes an incision part to form a central space and to define the opening formed in an inner surface of the main blade, wherein the sub-blade has a front end positioned higher than the incision part and a rear end positioned lower than the incision part.

9. The ceiling fan of claim 8, wherein the incision part includes:

a front incision end facing a leading edge of the main blade; and a rear incision end facing a trailing edge of the main blade, wherein the sub-blade has the front end positioned higher than the front incision end and the rear end positioned lower than the rear incision end.

10. The ceiling fan of claim 1, wherein the sub-blade includes:

a blade plate including a curved surface to guide air;

a sub-seating part positioned at one side of the blade plate to seat at the main blade; and a sub-connector positioned at an opposite side of the blade plate to seat at the main blade and another main blade.

11. A ceiling fan comprising:

a housing cover to receive a motor shaft to couple to an interior ceiling and a motor assembly to provide power;

a plurality of blades having respective blade holes defined along inner surfaces thereof and coupled to each other in a circumferential direction based on a central axis of the plurality of blades; and a plurality of sub-blades having respective sub-blades positioned in the respective blade holes, wherein a joint part with which the plurality of main blades make contact is fixed by the housing cover and the respective sub-blade, and wherein the sub-blade is disposed to have an angle of attack different from an angle of attack of the main blade.

12. The ceiling fan of claim 11, wherein the housing cover and a central portion of the respective sub-blade cross the joint part.

13. The ceiling fan of claim 11, wherein the housing cover, a main blade, and the respective sub-blade are fixed to each other by a coupling member.

14. The ceiling fan of claim 11, wherein the housing cover further includes:

a plurality of blade connectors extending in a radial direction from the housing cover and insert into the plurality of main blades such that centers of the blade connectors are positioned at the joint part.

15. The ceiling fan of claim 14, wherein a main blade has an inner front end into which one of the plurality of blade connectors is coupled, and an inner rear end into which another of the plurality of blade connectors is coupled.

16. The ceiling fan of claim 11, wherein each of the plurality of main blades includes:

a front coupling part positioned at an inner front end thereof and extending upward; and a rear coupling part positioned at an inner rear end thereof and extending upward, wherein each of the front coupling part and the rear coupling part includes:

a connector insertion part to couple to the housing cover; and a connector seating part formed on a top surface of the connector insertion part to seat the sub-blade thereon.

* * * * *